US010287060B1

(12) United States Patent
Kuesel

(10) Patent No.: US 10,287,060 B1
(45) Date of Patent: May 14, 2019

(54) WALL MATERIAL PAN HOLDER

(71) Applicant: Luke Murnice Kuesel, Cross Plains, WI (US)

(72) Inventor: Luke Murnice Kuesel, Cross Plains, WI (US)

(73) Assignee: Luke Murnice Kuesel, Cross Plains, WI (US)

( * ) Notice: Subject to any disclaimer, the term of this patent is extended or adjusted under 35 U.S.C. 154(b) by 29 days.

(21) Appl. No.: 15/684,000

(22) Filed: Aug. 23, 2017

(51) Int. Cl.

| | |
|---|---|
| ***B65D 25/28*** | (2006.01) |
| ***B65D 1/34*** | (2006.01) |
| *E04G 23/02* | (2006.01) |
| *E04F 21/05* | (2006.01) |

(52) U.S. Cl.
CPC ..... *B65D 25/2885* (2013.01); *B65D 1/34* (2013.01); *E04F 21/05* (2013.01); *E04G 23/0207* (2013.01)

(58) Field of Classification Search
CPC ..... B65D 25/28–25/2885; B65D 1/34; E04F 21/05; E04F 21/02; E04F 21/0203; E04G 23/0207
USPC ..... 248/682, 155.1; 224/101–666
See application file for complete search history.

(56) References Cited

U.S. PATENT DOCUMENTS

| | | | |
|---|---|---|---|
| 5,261,584 | A | 11/1993 | Albert |
| 5,358,161 | A | 10/1994 | Perugini |
| 5,553,348 | A | 9/1996 | Brandenburger |
| 5,971,101 | A | 10/1999 | Taggart |
| 6,006,936 | A | 12/1999 | Przybylowicz |
| 6,508,390 | B1 | 1/2003 | Karpati |
| 6,575,328 | B1 | 6/2003 | Foraker |
| 6,637,792 | B1 | 10/2003 | McCoy et al. |
| 6,840,415 | B1 | 1/2005 | Sapien, Jr. |
| 6,923,485 | B1 | 8/2005 | Bauswell |
| 7,243,804 | B2 | 7/2007 | Miller |
| 7,497,327 | B2 | 3/2009 | Martinez et al. |
| D769,643 | S * | 10/2016 | Holton ..... D6/553 |
| 9,545,815 | B2 * | 1/2017 | Kiceniuk ..... B44D 3/126 |
| 9,598,872 | B2 | 3/2017 | Zappia |

(Continued)

FOREIGN PATENT DOCUMENTS

| | | |
|---|---|---|
| CA | 2613420 | 6/2009 |
| WO | WO2010033681 | 3/2010 |

OTHER PUBLICATIONS

Drywall Mud Pan & Tape Holder, http:/www.all-wall.com/Drywall-Pan-Holder.html, Available on May 19, 2017.

*Primary Examiner* — Kareen K Thomas
(74) *Attorney, Agent, or Firm* — Bell & Manning, LLC

(57) ABSTRACT

A pan holder includes a base plate, a handle, and a wrist support. The base plate has an interior surface and an exterior surface. The handle includes a first arc-shaped wall mounted to the exterior surface of the base plate. The first arc-shaped wall is sized to fit and rest within a palm of a hand when the pan holder is used. The wrist support includes a second arc-shaped wall mounted to the exterior surface to extend perpendicularly from the exterior surface. A minimum distance between the first arc-shaped wall and the second arc-shaped wall is selected to accommodate a thumb-wrist portion of the hand. The second arc-shaped wall is curved when projected into a first plane defined by the exterior surface. The second arc-shaped wall is concave relative to a second plane that extends through a lengthwise center of the handle and is perpendicular to the first plane.

20 Claims, 28 Drawing Sheets

(56) References Cited

U.S. PATENT DOCUMENTS

| | | | | |
|---|---|---|---|---|
| 9,677,289 | B2 | 6/2017 | Simek | |
| 9,790,000 | B1 * | 10/2017 | Holton | B65D 25/20 |
| 2002/0020730 | A1 | 2/2002 | Baird | |
| 2004/0256433 | A1 | 12/2004 | Baird | |
| 2006/0169705 | A1 * | 8/2006 | Pool | E04G 21/005 220/629 |
| 2006/0273086 | A1 | 12/2006 | Marino et al. | |
| 2007/0107337 | A1 | 5/2007 | Whitlock et al. | |
| 2007/0176058 | A1 * | 8/2007 | Kohn | A47F 9/042 248/100 |
| 2008/0315600 | A1 | 12/2008 | Fischer | |
| 2009/0250294 | A1 * | 10/2009 | Byers | E06C 7/14 182/129 |
| 2011/0290803 | A1 * | 12/2011 | Kehres | E04G 21/005 220/475 |
| 2012/0067906 | A1 | 3/2012 | Szasz | |

* cited by examiner

WALL MATERIAL PAN HOLDER

BACKGROUND

Various materials are applied as part of a process of constructing and finishing a wall. For example, various types of joint compound, cement, mortar, paint, textured paint, plaster, adhesive, etc. may be poured into a container and applied to the wall using various tools, such as a paint brush, a paint roller, a putty knife, a trowel, etc. as part of the construction and texturing of the wall. The container may be held in a hand of a user applying the material. The containers are designed for ease in applying the material, which is not necessarily conducive to the comfort of the user. For example, a joint compound container, also referred to as a mud pan, is filled with joint compound used by dry wall finishers to cover the joints formed between wallboard to make a smooth surface. The pans are normally trapezoidal in shape and somewhat difficult to hold when filled with the joint compound, especially for extended periods of time because the pan is heavy, slippery, and not shaped to be easily held in a user's hand. For illustration, a filled mud pan can weigh in excess of five pounds. Additionally, when the user retrieves the joint compound from the mud pan, downward pressure is exerted on the pan causing the user to squeeze harder and to tighten their grip on the pan with their fingers. As a result, muscle strain, stiffness in the hand and wrist, and long term joint problems can arise.

SUMMARY

In an example embodiment, a pan holder is provided. The pan holder includes, but is not limited to, a base plate, a handle, and a wrist support. The base plate includes, but is not limited to, an interior surface and an exterior surface. The handle includes, but is not limited to, a first arc-shaped wall and a flat wall. The flat wall is mounted to the exterior surface of the base plate. The first arc-shaped wall extends from opposite edges of the flat wall. The first arc-shaped wall is sized to fit and rest within a palm of a hand when the pan holder is held by a user. The wrist support includes, but is not limited to, a second arc-shaped wall mounted to the exterior surface of the base plate to extend perpendicularly from the exterior surface of the base plate. A minimum distance between the first arc-shaped wall and the second arc-shaped wall is selected to accommodate a thumb-wrist portion of the hand when the pan holder is held by the user. The second arc-shaped wall is curved when projected into a first plane defined by the exterior surface of the base plate. The second arc-shaped wall is concave relative to a second plane. The second plane extends through a lengthwise center of the handle and is perpendicular to the first plane.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
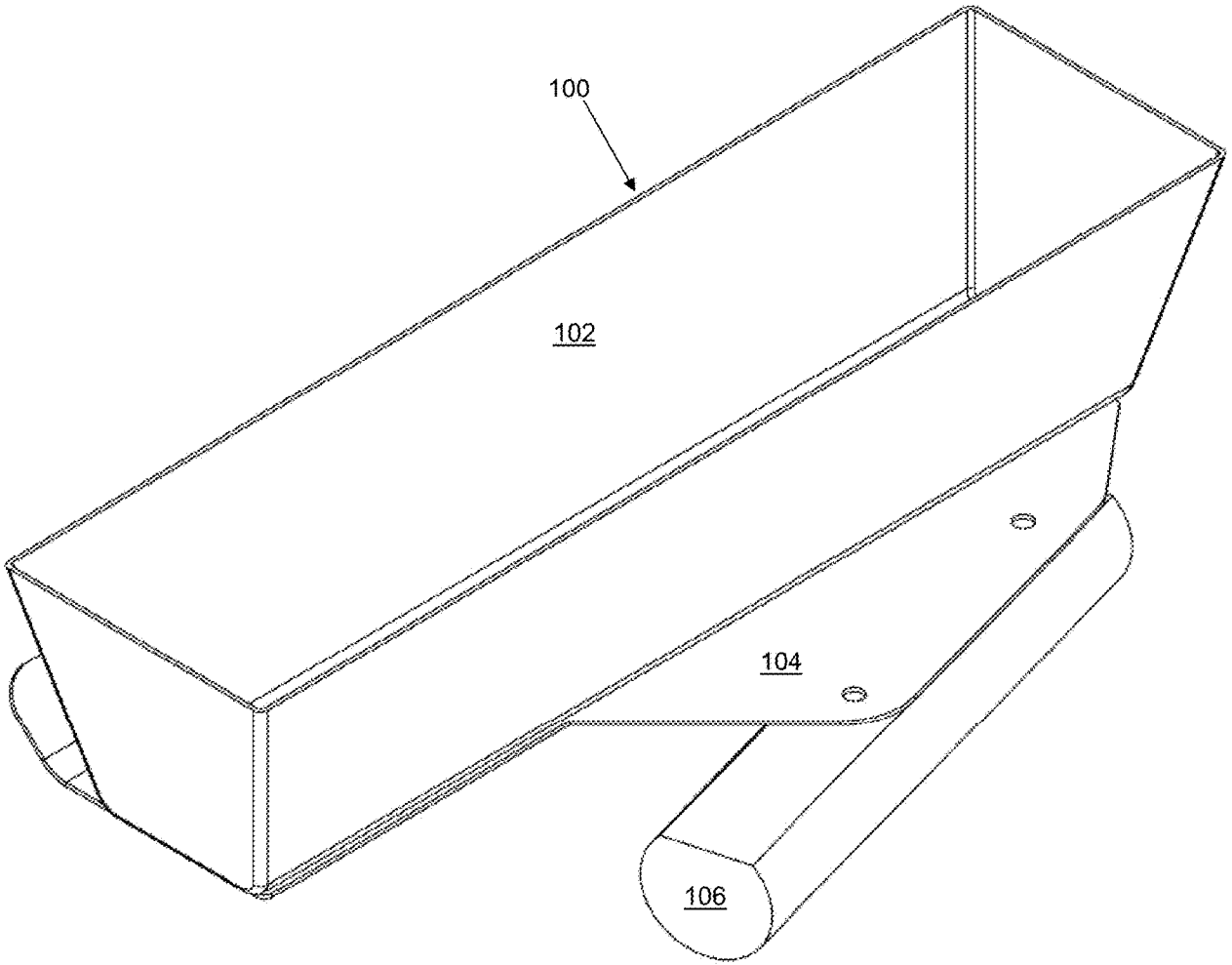
FIG. 1 depicts a top, front, right perspective view of a pan holder system in accordance with an illustrative embodiment.
Figure 2:
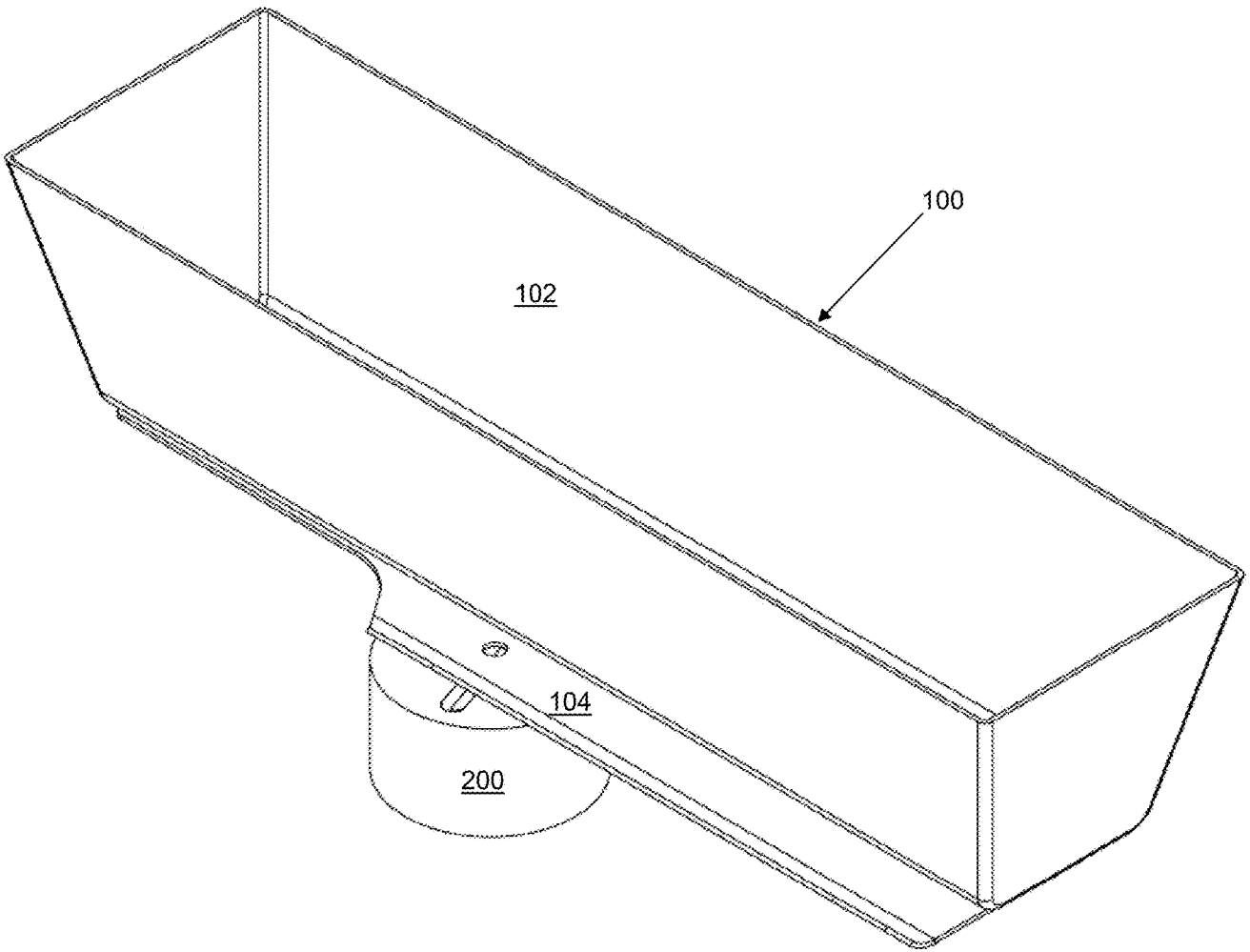
FIG. 2 depicts a top, front, left perspective view of the pan holder system of FIG. 1 in accordance with an illustrative embodiment.
Figure 3:
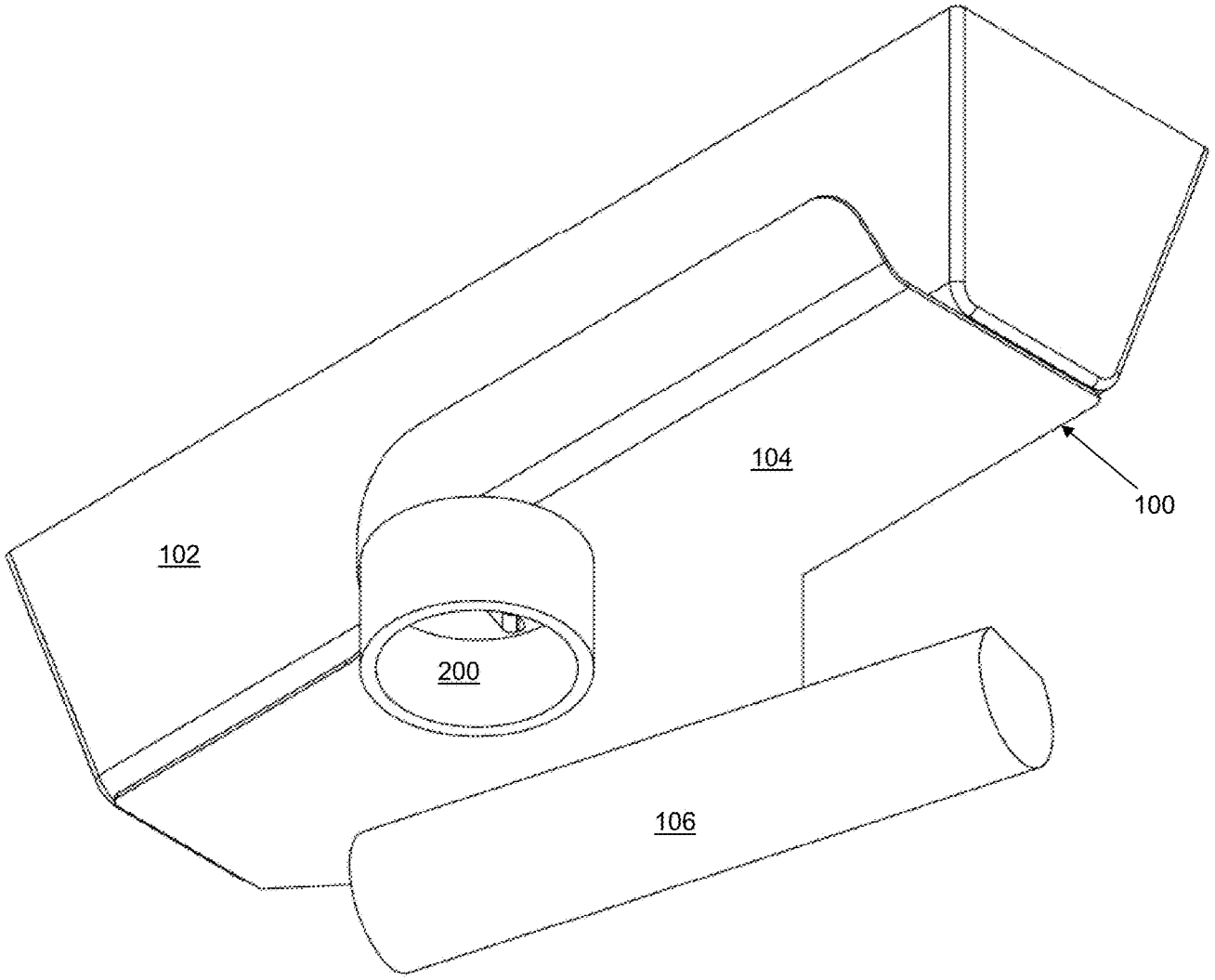
FIG. 3 depicts a bottom, front, left perspective view of the pan holder system of FIG. 1 in accordance with an illustrative embodiment.
Figure 4:
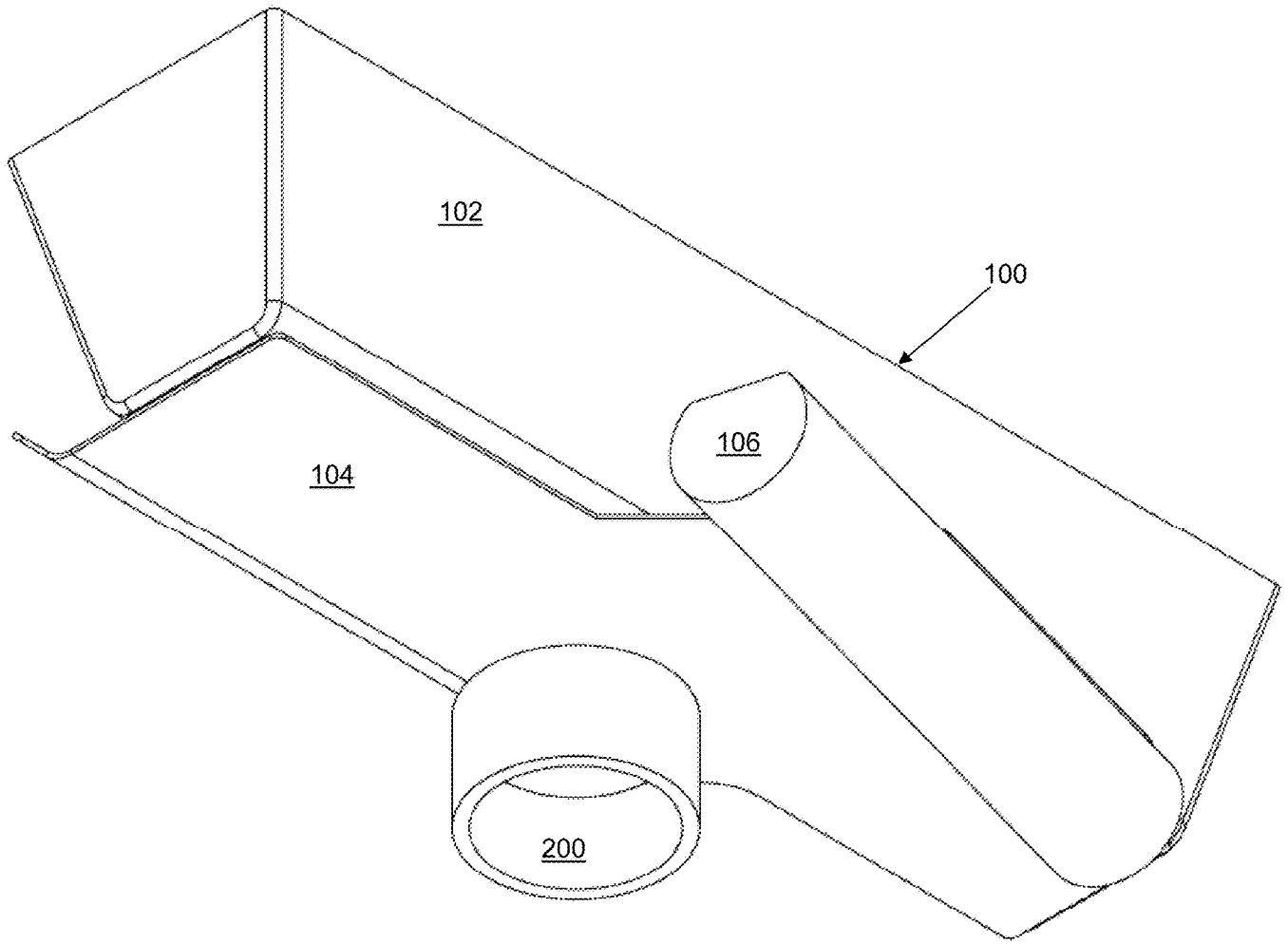
FIG. 4 depicts a bottom, front, right perspective view of the pan holder system of FIG. 1 in accordance with an illustrative embodiment.
Figure 5:
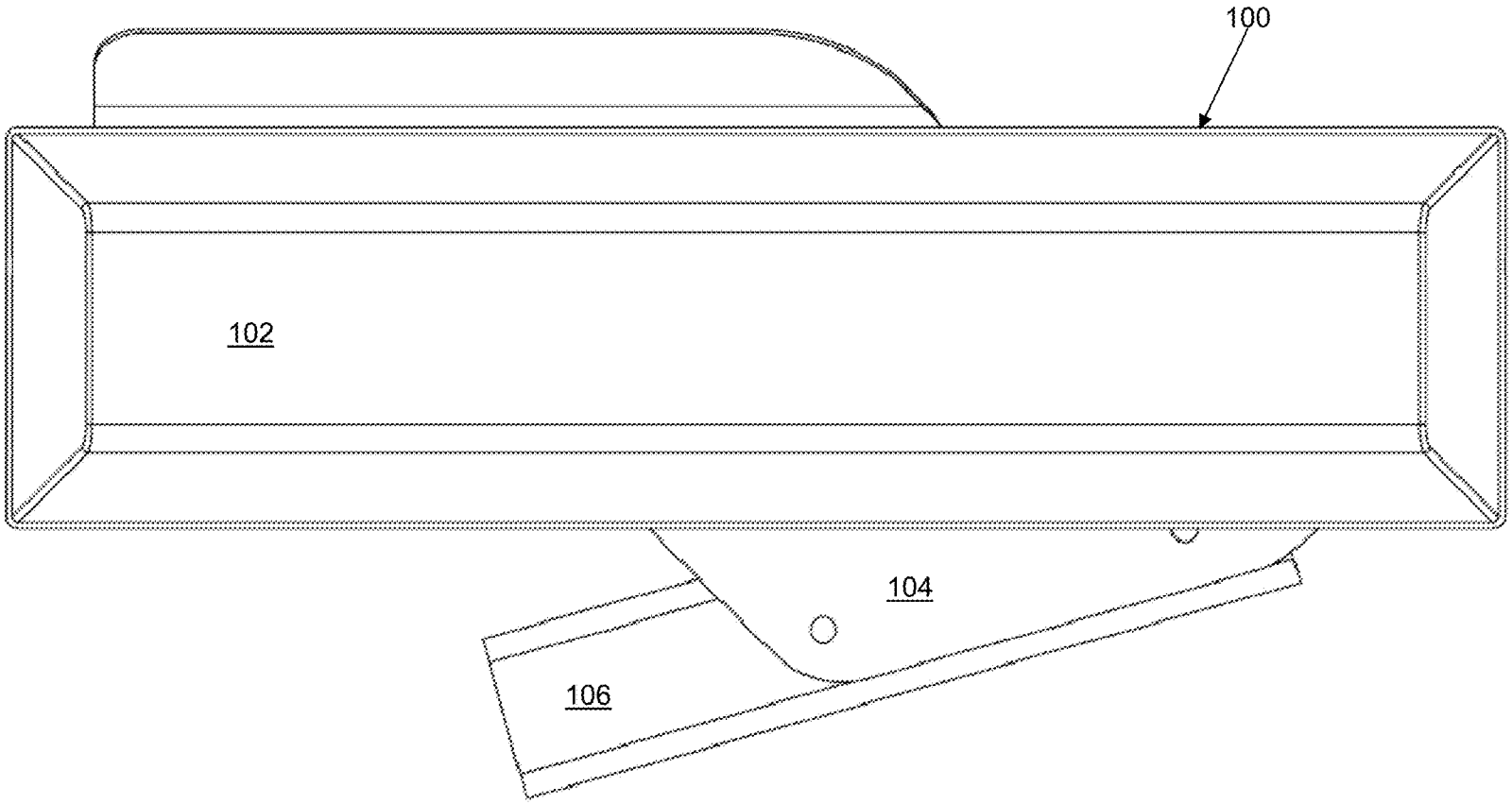
FIG. 5 depicts a top view of the pan holder system of FIG. 1 in accordance with an illustrative embodiment.
Figure 6:
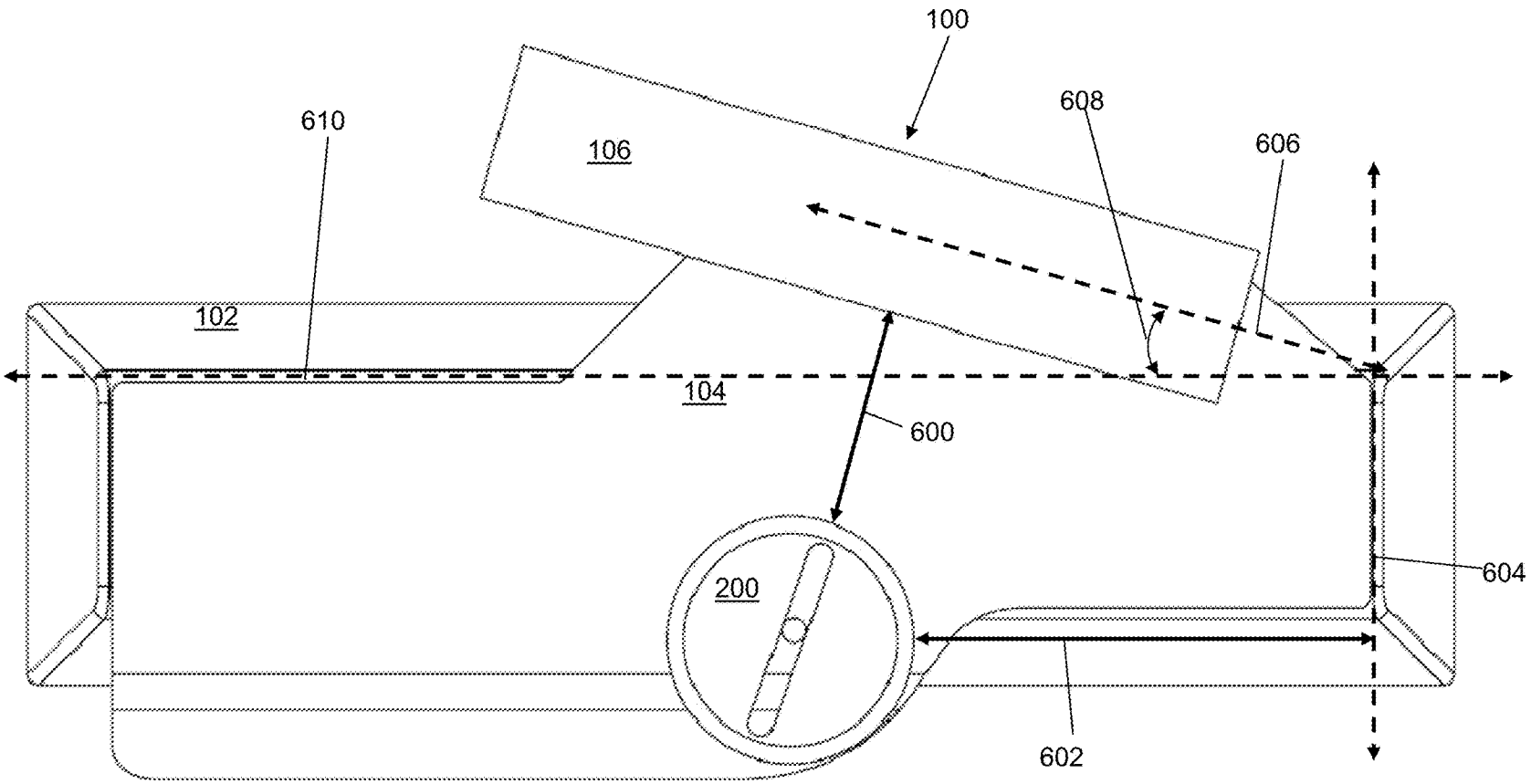
FIG. 6 depicts a bottom view of the pan holder system of FIG. 1 in accordance with an illustrative embodiment.
Figure 7:
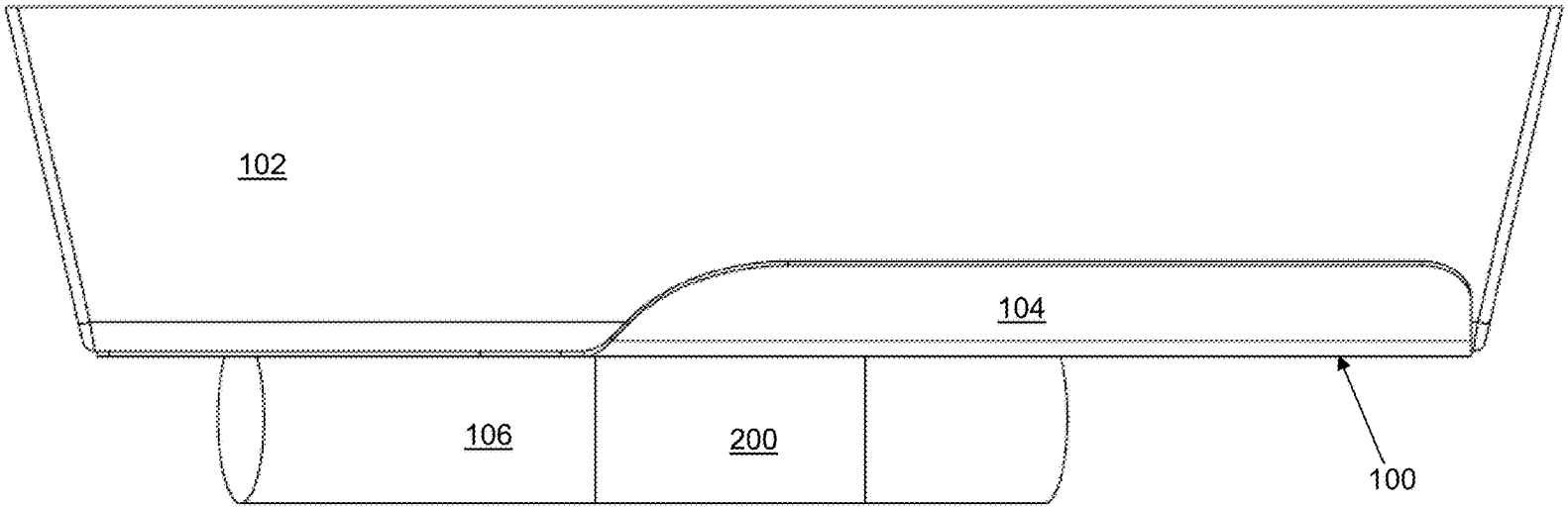
FIG. 7 depicts a left side view of the pan holder system of FIG. 1 in accordance with an illustrative embodiment.
Figure 8:
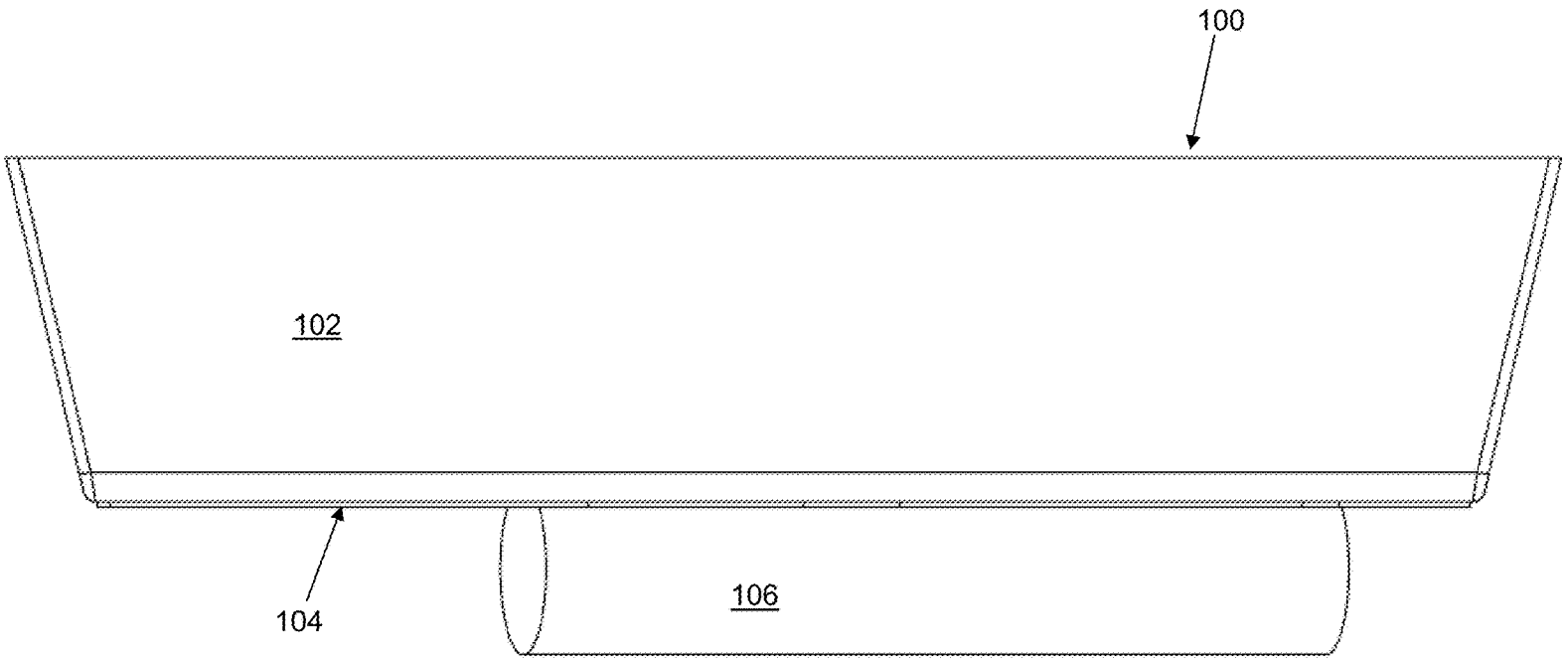
FIG. 8 depicts a right side view of the pan holder system of FIG. 1 in accordance with an illustrative embodiment.
Figure 9:
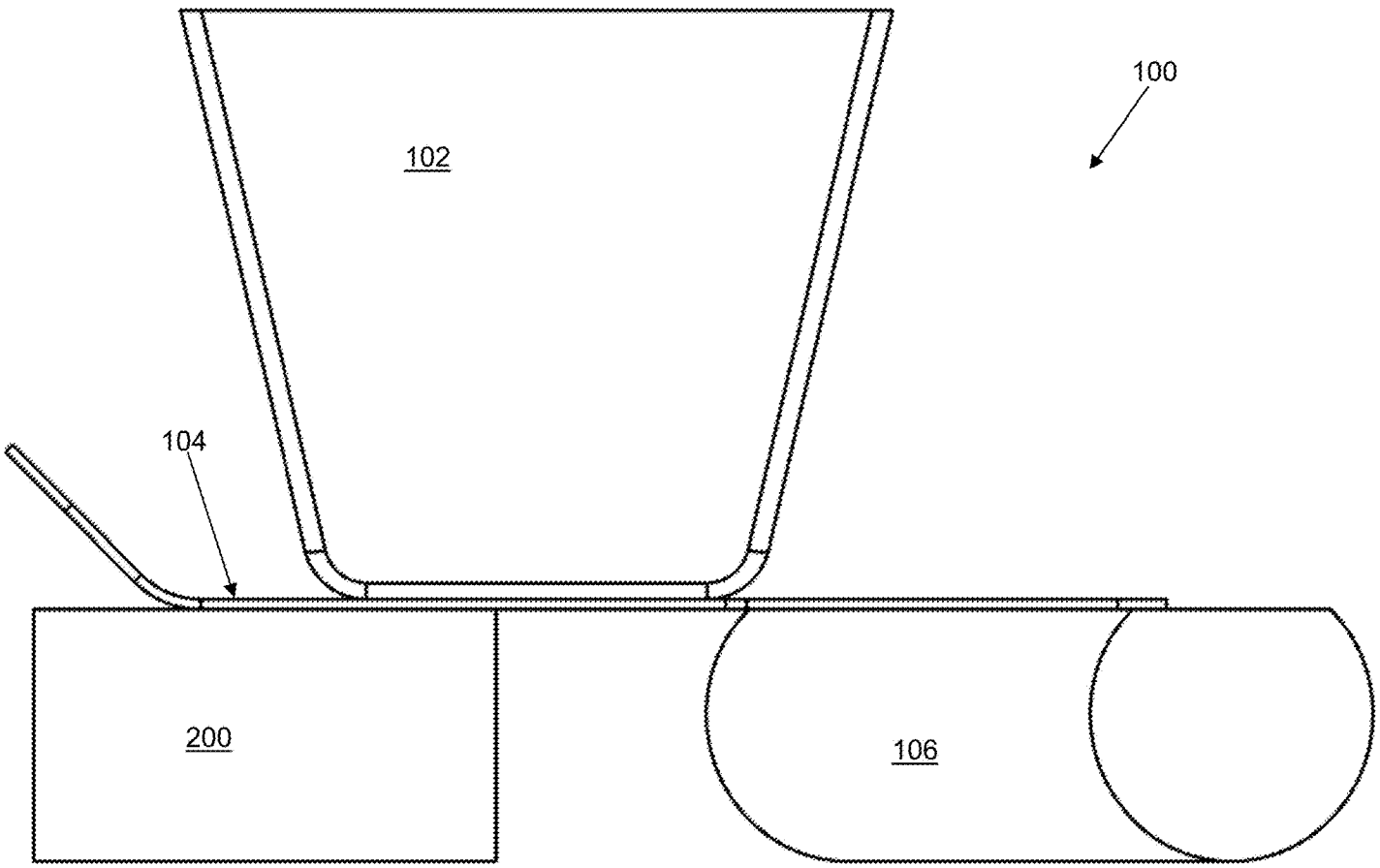
FIG. 9 depicts a front view of the pan holder system of FIG. 1 in accordance with an illustrative embodiment.

With reference to FIG. 1, a top, front, right perspective view of a pan holder system 100 is shown in accordance with an illustrative embodiment. With reference to FIG. 2, a top, front, left perspective view of pan holder system 100 is shown in accordance with an illustrative embodiment. With reference to FIG. 3, a bottom, front, left perspective view of pan holder system 100 is shown in accordance with an illustrative embodiment. With reference to FIG. 4, a bottom, front, right perspective view of pan holder system 100 is shown in accordance with an illustrative embodiment. With reference to FIG. 5, a top view of pan holder system 100 is shown in accordance with an illustrative embodiment. With reference to FIG. 6, a bottom view of pan holder system 100 is shown in accordance with an illustrative embodiment. With reference to FIG. 7, a left side view of pan holder system 100 is shown in accordance with an illustrative embodiment. With reference to FIG. 8, a right side view of pan holder system 100 is shown in accordance with an illustrative embodiment. With reference to FIG. 9, a front view of pan holder system 100 is shown in accordance with an illustrative embodiment.

Figure 29:
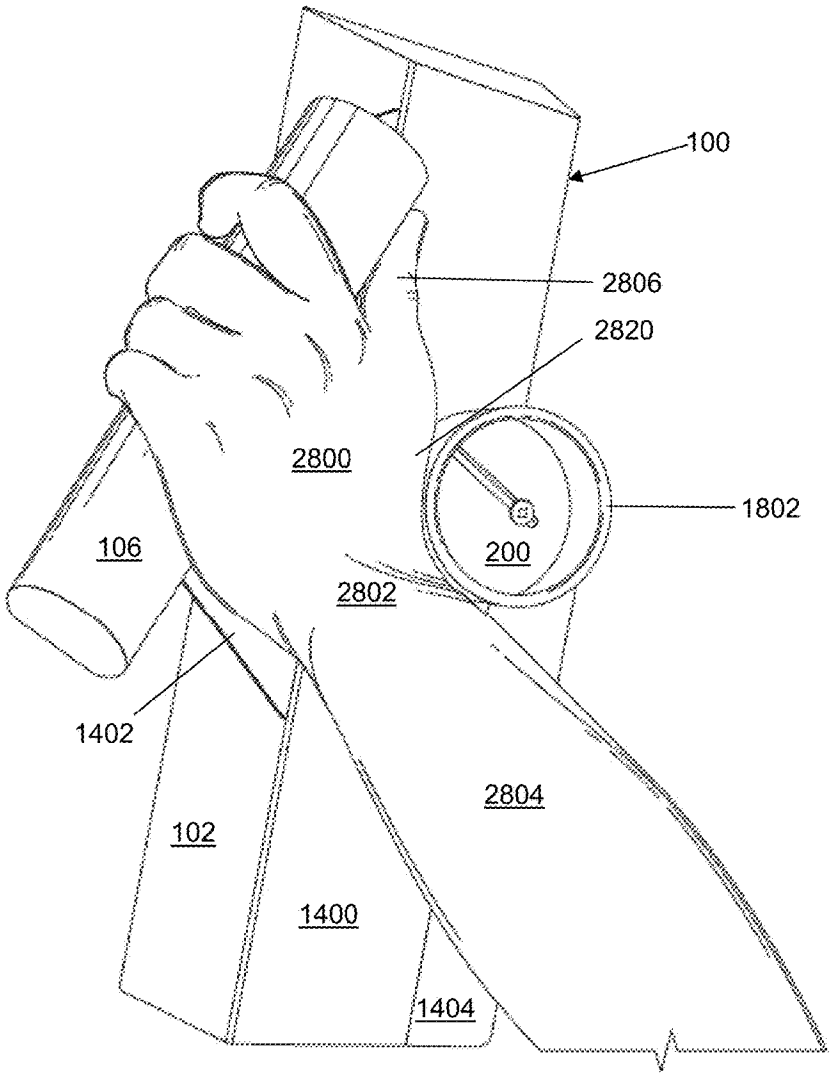
FIG. 29 depicts a bottom perspective view of the pan holder system of FIG. 1 being held by a user in accordance with an illustrative embodiment.

Pan holder system 100 may include a pan 102, a holder base 104, a handle 106, and a wrist support 200 (shown referring to FIG. 2). Pan holder system 100 may be used by a user to apply various materials as part of a process of constructing and finishing a wall. For example, various types of joint compound, cement, mortar, paint, textured paint, plaster, adhesive, etc. are poured into pan 102 and applied to the wall using various tools, such as a paint brush, a paint roller, a putty knife, a trowel, etc. The application tool is dipped into the material by the user and applied to the wall as needed. Typically, pan holder system 100 is held in a hand of a user as illustrated in FIG. 29 and described further below.

Pan holder system 100 can be designed for being held in a right-hand or a left-hand of the user. For example, typically pan holder system 100 is held in a left-hand of a right-handed user and in a right-hand of a left-handed user. The illustrative embodiments show pan holder system 100 designed for use by the right-handed user. The orientation of components of pan holder system 100 can be reversed relative to a lengthwise center of pan holder system 100 to make pan holder system 100 designed for use by the left-handed user. A front of pan holder system 100 is held closest to a body of the user when pan holder system 100 is used. Handle 106 rests in a palm of the hand of the user with a thumb-wrist portion of the hand supported by wrist support 200 and a forearm of the user resting against a portion of holder base 104.

Use of directional terms, such as top, bottom, right, left, front, back, etc. are merely intended to facilitate reference to the various surfaces and elements of the described structures relative to the orientations shown in the drawings and are not intended to be limiting in any manner.

Pan 102 is mounted to a top surface of holder base 104 and forms a container to hold the material when used. Handle 106 is mounted to a bottom surface of holder base 104 to extend downwards in a direction opposite pan 102. Wrist support 200 is mounted to the bottom surface of holder base 104 also to extend downwards in the direction opposite pan 102.

As used in this disclosure, the term "mount" includes join, unite, connect, couple, associate, insert, hang, hold, affix, attach, fasten, bind, paste, secure, bolt, screw, rivet, solder, weld, glue, adhere, form over, layer, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

In alternative embodiments, pan holder system 100 may include a fewer or a greater number of components. The components of pan holder system 100 may be formed of one or more materials, such as metal (e.g., steel, aluminum), glass, rubber, wood, plastic and/or another elastomeric material having a sufficient strength and rigidity that is sufficiently light and non-slippery and non-reactive to the material poured in pan 102 to provide the illustrated and/or described function. Merely for illustration, pan 102, holder base 104, and wrist support 200 may be formed of a lightweight metal or plastic. Handle 106 may be formed of wood or another material coated at least partially with wood or rubber so that handle 106 is not slippery when wet or coated in the material held in pan 102. The components of pan holder system 100 further may be formed as one or more distinct components or as a single continuous piece of material, for example, by molding.

Referring to FIG. 6, wrist support 200 is mounted a left-right distance 600 relative to handle 106. Left-right distance 600 is a minimum distance between a closest edge of wrist support 200 and a closest edge of handle 106. Wrist support 200 is also mounted a front-back distance 602 relative to a back, bottom edge 604 of pan 102. Front-back distance 602 is a minimum distance between a closest edge of wrist support 200 and a closest front-back edge of pan 102, which in the illustrative embodiment is back, bottom edge 604. In an illustrative embodiment, both left-right distance 600 and front-back distance 602 are adjustable to better fit a user's wrist, hand, and forearm and to comfortably balance a weight of pan 102 on the user's wrist, hand, and forearm. A lengthwise center of handle 106 illustrated by a handle lengthwise center line 606 is mounted to holder base 104 to form a handle angle 608 between 5 degrees and 45 degrees relative to a right, bottom edge 610 of pan 102.

Figure 10:
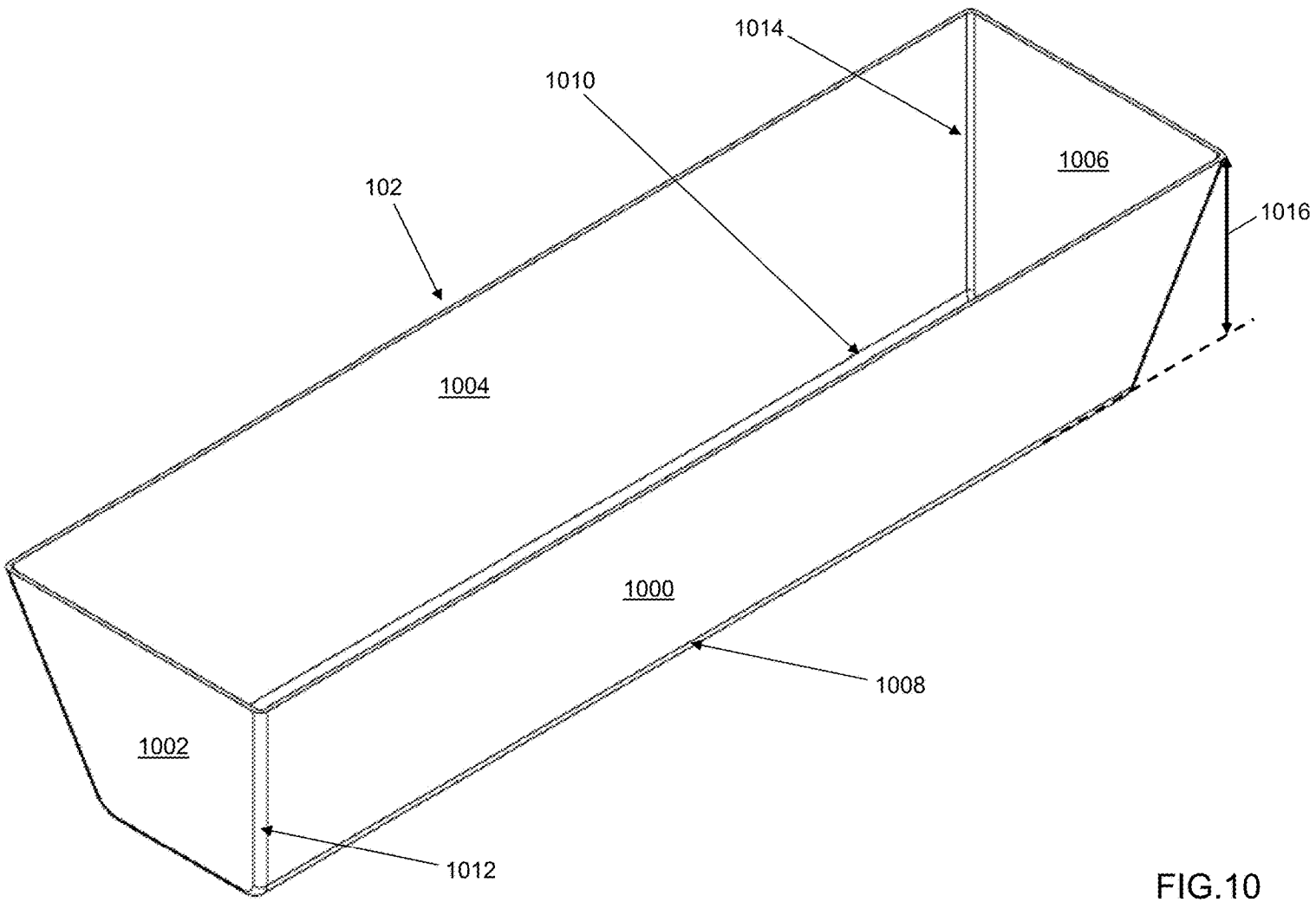
FIG. 10 depicts a front perspective view of a pan of the pan holder system of FIG. 1 in accordance with an illustrative embodiment.
Figure 11:
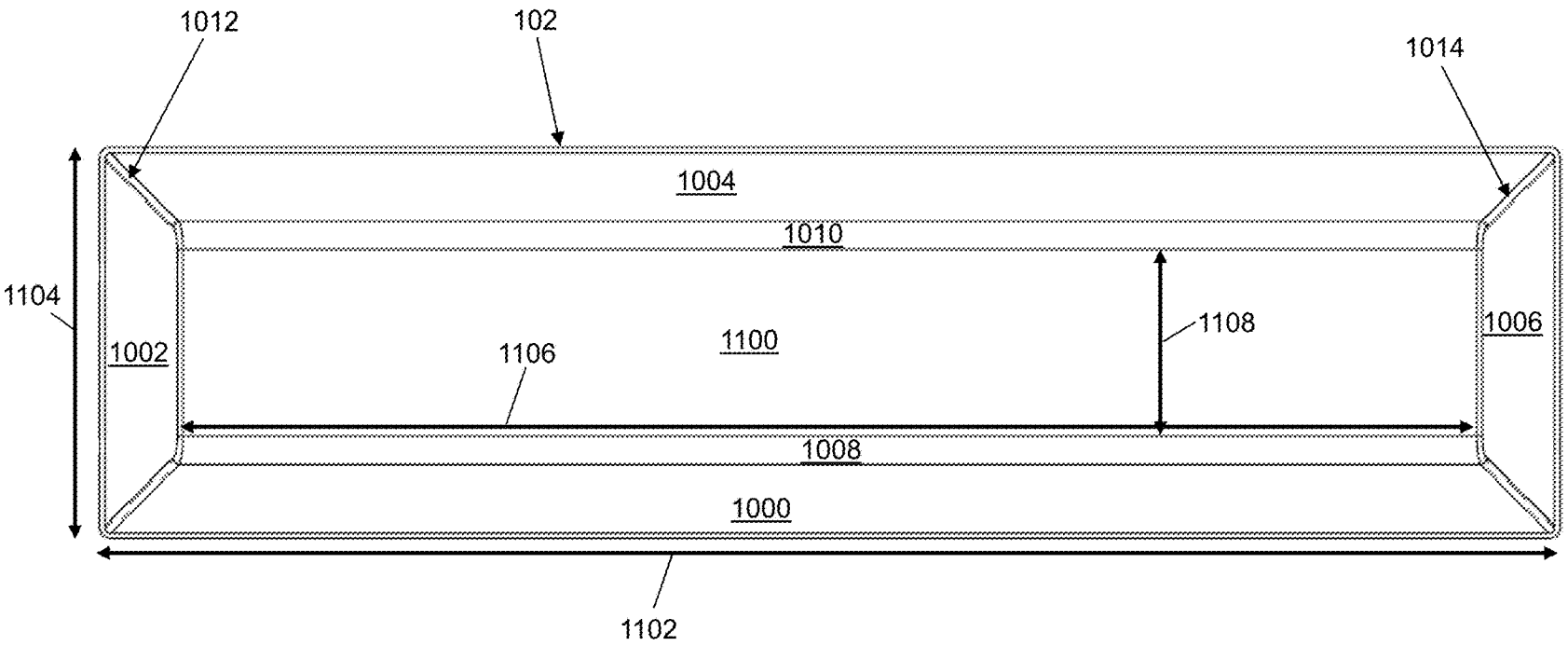
FIG. 11 depicts a top view of the pan of FIG. 10 in accordance with an illustrative embodiment.

Referring to FIG. 10, a front perspective view of pan 102 is shown in accordance with an illustrative embodiment. Referring to FIG. 11, a top view of pan 102 is shown in accordance with an illustrative embodiment. Pan 102 includes a bottom wall 1100 (shown referring to FIG. 11), a right sidewall 1000, a front sidewall 1002, a left sidewall 1004, a back sidewall 1006, a right transition wall 1008, a left transition wall 1010, a front joint wall 1012, and a back joint wall 1014. Bottom wall 1100 may be formed by a portion of holder base 104 or may be mounted to holder base 104.

In the illustrative embodiment, pan 102 forms a rectangular open container with sidewalls that slope upward and outward relative to bottom wall 1100 so that a periphery of pan 102 on the open side has larger dimensions than bottom wall 1100. In alternative embodiments, pan 102 can include a fewer or a greater number of sidewalls to form different shaped open containers such as a circular open container, an elliptical open container, a triangular open container, a square open container, etc. The sidewalls further need not be sloped outward. Pan 102 further may be larger or smaller in various embodiments. For illustration, pan 102 has a height 1016 of approximately 3.5 inches, an exterior pan length 1102 of approximately 15.75 inches, an exterior pan width 1104 of approximately 4.25 inches, an interior pan length 1106 of approximately 14 inches, and an interior pan width 1108 of approximately 2.5 inches.

In the illustrative embodiment, bottom wall 1100, right sidewall 1000, front sidewall 1002, left sidewall 1004, and back sidewall 1006 are straight and flat. Right transition wall 1008 is formed between bottom wall 1100 and right sidewall 1000 to provide the outward slope relative to bottom wall 1100. Left transition wall 1010 is formed between bottom wall 1100 and left sidewall 1004 to provide the outward slope relative to bottom wall 1100. Front joint wall 1012 is formed between front sidewall 1002 and left sidewall 1004, bottom wall 1100, and right sidewall 1000 to connect front sidewall 1002 to the adjacent walls. Back joint wall 1014 is formed between back sidewall 1006 and left sidewall 1004, bottom wall 1100, and right sidewall 1000 to connect back sidewall 1006 to the adjacent walls. The plurality of walls that form pan 102 may be formed as a single continuous piece of material, for example, by molding, bending, and/or soldering or may be formed of a plurality of pieces of material mounted to each other.

Figure 12:
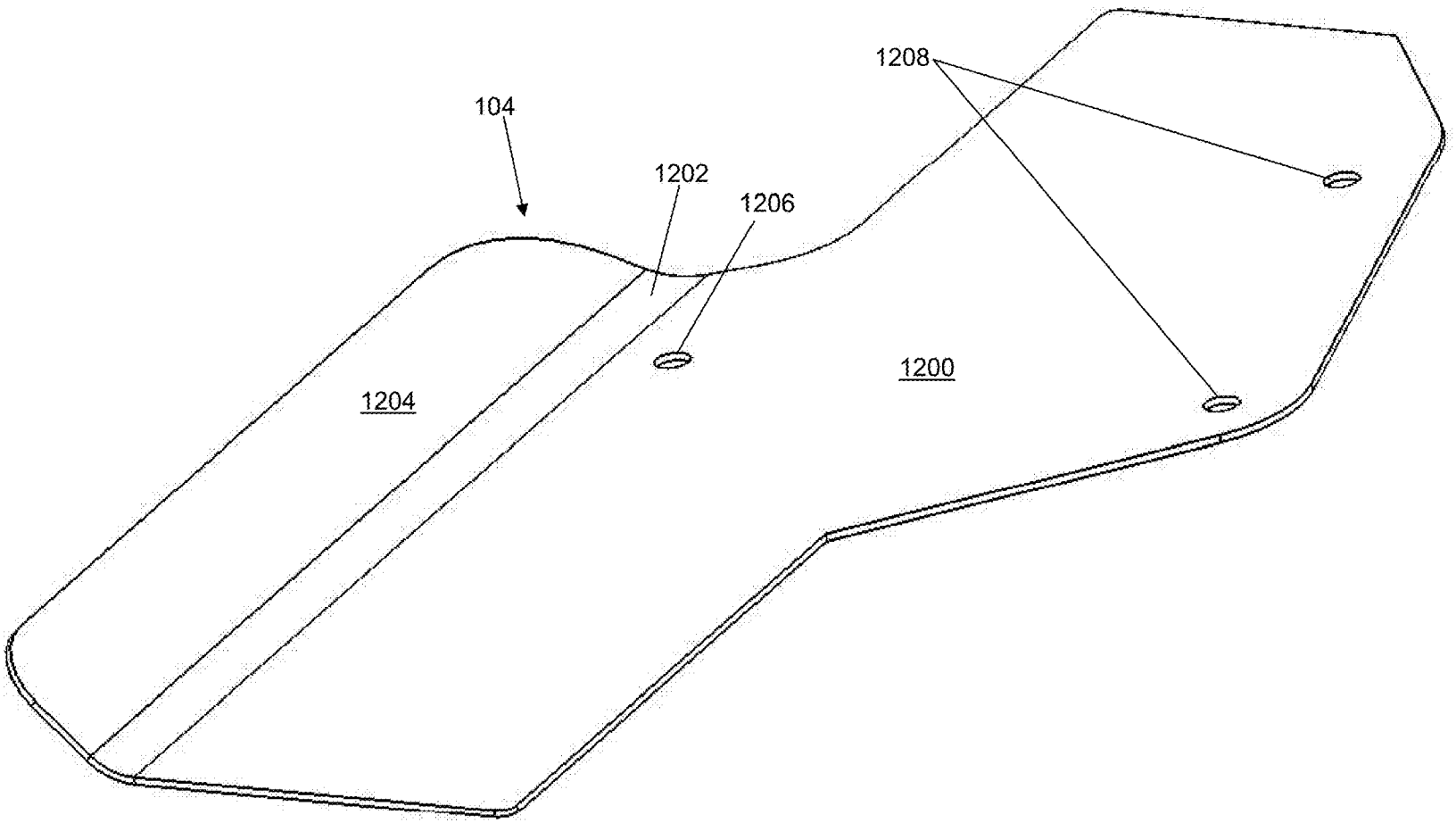
FIG. 12 depicts a top, front, right perspective view of a holder base of the pan holder system of FIG. 1 in accordance with an illustrative embodiment.
Figure 13:
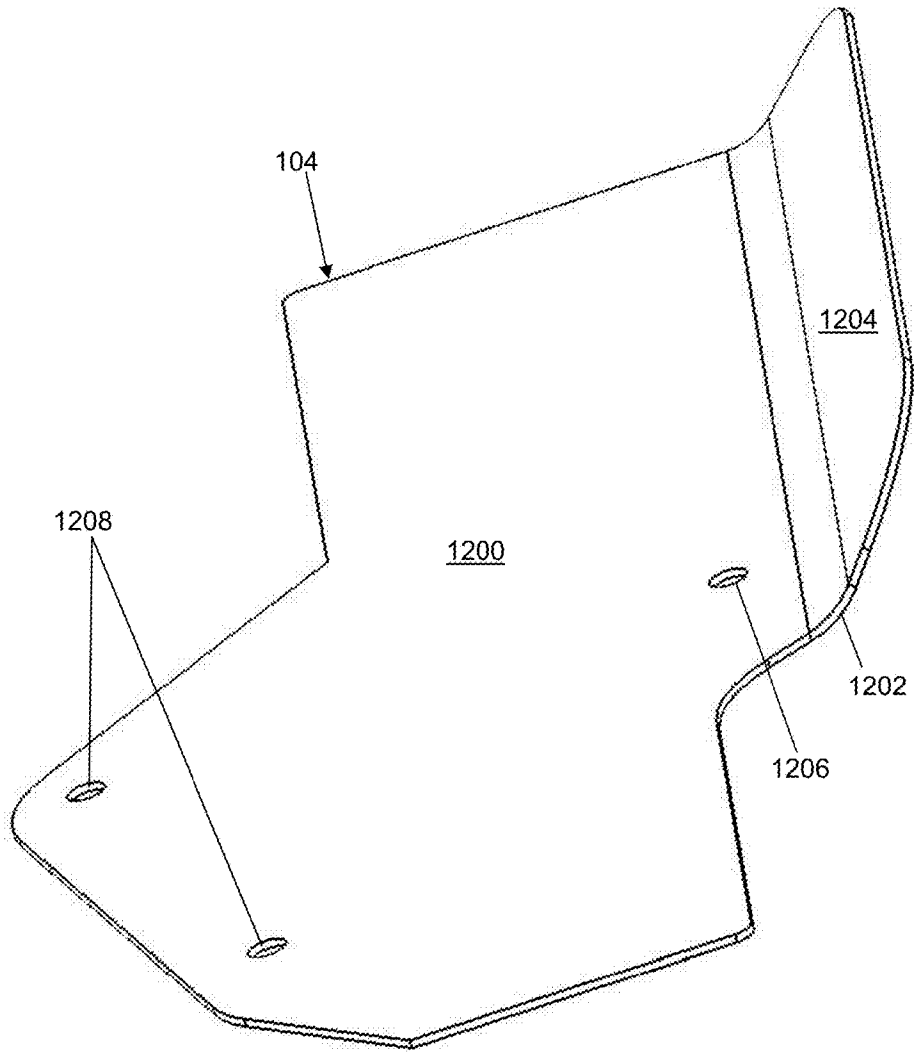
FIG. 13 depicts a top, back, left perspective view of the holder base of FIG. 12 in accordance with an illustrative embodiment.
Figure 14:
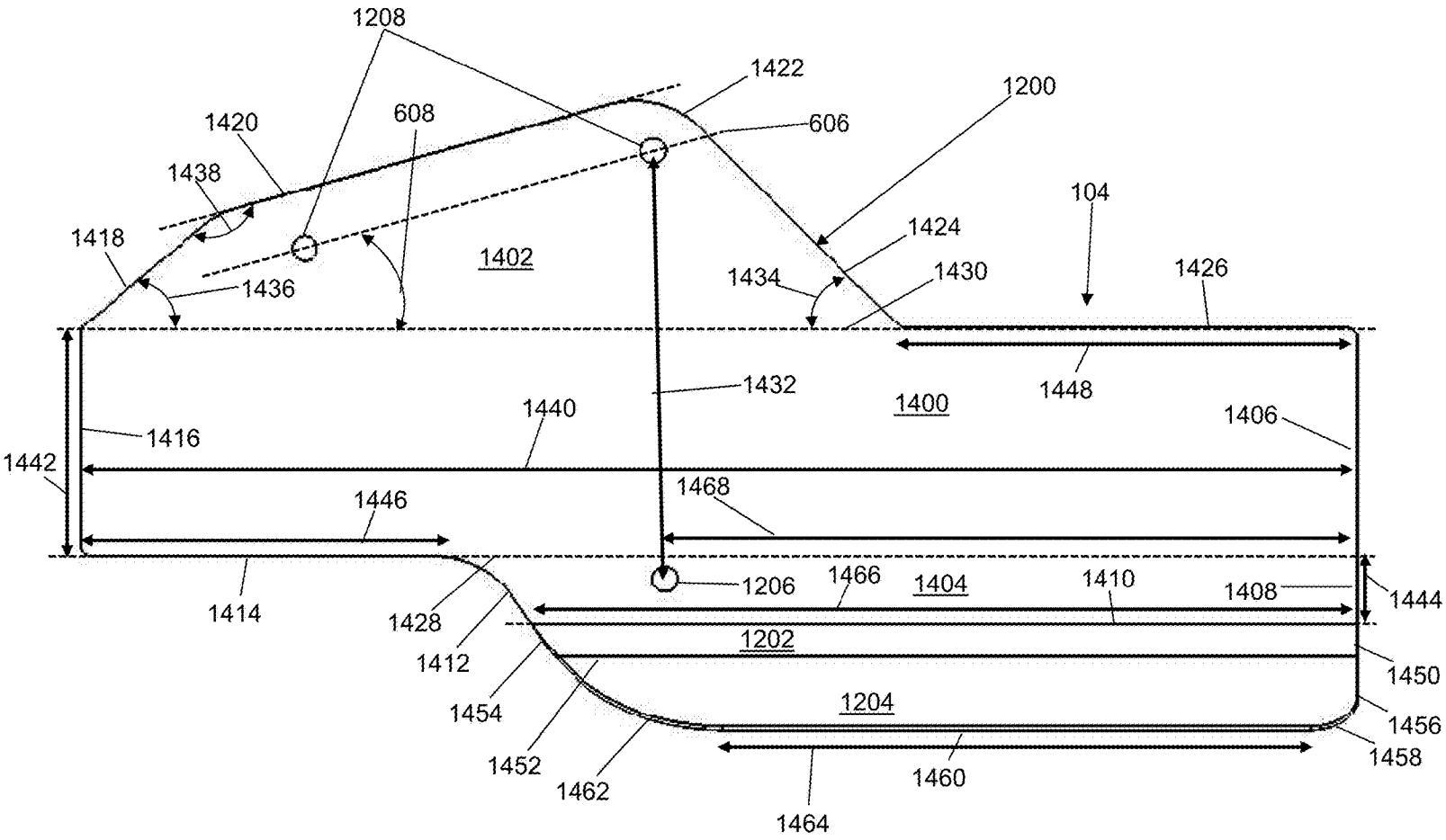
FIG. 14 depicts a top view of the holder base of FIG. 12 in accordance with an illustrative embodiment.
Figure 15:
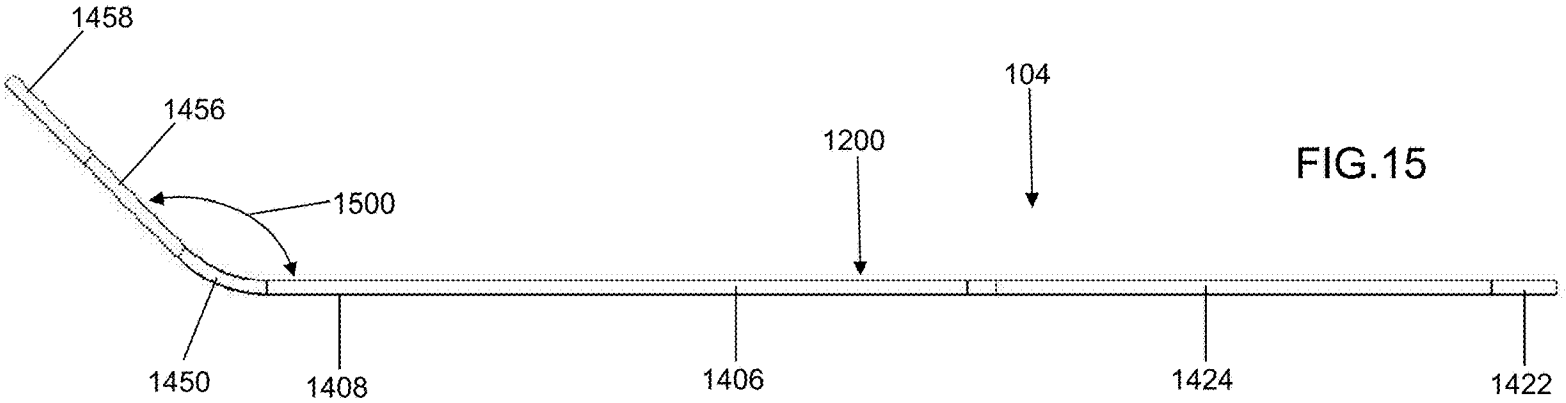
FIG. 15 depicts a front view of the holder base of FIG. 12 in accordance with an illustrative embodiment.
Figure 16:
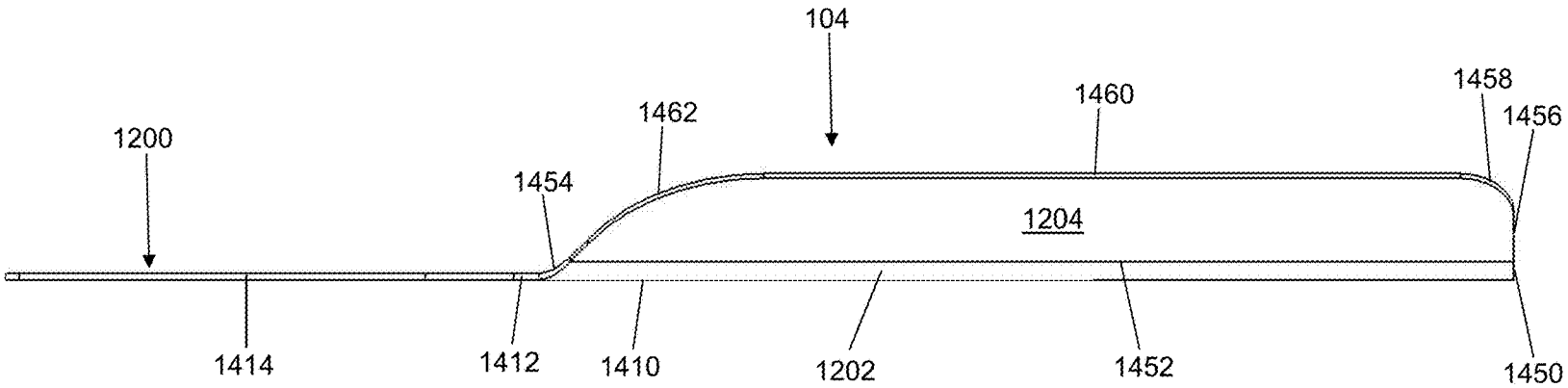
FIG. 16 depicts a left side view of the holder base of FIG. 12 in accordance with an illustrative embodiment.

Referring to FIG. 12, a top, front, right perspective view of holder base 104 is shown in accordance with an illustrative embodiment. Referring to FIG. 13, a top, back, left perspective view of holder base 104 is shown in accordance with an illustrative embodiment. Referring to FIG. 14, a top view of holder base 104 is shown in accordance with an illustrative embodiment. Referring to FIG. 15, a front view of holder base 104 is shown in accordance with an illustrative embodiment. Referring to FIG. 16, a left side view of holder base 104 is shown in accordance with an illustrative embodiment. Holder base 104 may be mounted to an exterior surface of bottom wall 1100 of pan 102 or may include bottom wall 1100 of pan 102. For illustration, holder base 104 may be mounted to an exterior surface of bottom wall 1100 using adhesive, soldering, using fasteners such as screws or rivets, etc.

Holder base 104 may include a base plate 1200, a transition wall 1202, a forearm support wall 1204, a wrist support fastener aperture wall 1206, and one or more handle fastener aperture walls 1208. In the illustrative embodiment, base plate 1200 and forearm support wall 1204 are straight and flat. Transition wall 1202 is formed between base plate 1200 and forearm support wall 1204 to provide an upward slope relative to base plate 1200. When used, forearm support wall 1204 rests against a forearm of a user. The slope may be selected to form an support wall angle 1500 (shown referring to FIG. 15) between 105 and 180 degrees relative to a plane that is parallel to base plate 1200.

One or more fasteners, such as screws or rivets, may be inserted through wrist support fastener aperture wall 1206 and into wrist support 200 to mount wrist support 200 to base plate 1200. One or more fasteners, such as screws or rivets, may be inserted through the one or more handle fastener aperture walls 1208 and into handle 106 to mount handle 106 to base plate 1200.

Holder base 104 may be formed of a continuous piece of material, for example, by molding, bending, and/or soldering. Holder base 104 further may have a variety of shapes and sizes that may encompass bottom wall 1100 and may or may not extend to the right from bottom wall 1100 and/or to the left from bottom wall 1100 to accommodate the one or more handle fastener aperture walls 1208 and wrist support fastener aperture wall 1206. For example, holder base 104 may be circular, elliptical, a triangular, a square, rectangular, etc.

Referring to the illustrative embodiment of FIG. 14, base plate 1200 may include a base center plate 1400, a base right plate 1402, and a base left plate 1404 though these may be formed of a continuous piece of material. Base center plate 1400 may include a center, front edge 1406, a left front edge 1408, a left center boundary 1428, a curved transition edge 1412, a center, left edge 1414, a center, back edge 1416, a right center boundary 1430, and a center, right edge 1426. Left center boundary 1428 and right center boundary 1430 are merely to facilitate a description of a shape of base plate 1200 in the illustrative embodiment and may or may not form edges of base plate 1200. Base center plate 1400 is generally rectangular though base center plate 1400 may optionally include curved corners to avoid sharp edges and may optionally have other shapes that generally conform to bottom wall 1100 of pan 102.

Base center plate 1400 has a center length 1440 defined between center, front edge 1406 and center, back edge 1416. Base center plate 1400 has a center, back width 1442 defined between center, left edge 1414 and center, right edge 1426 (if extended in a parallel manner). Center, left edge 1414 has a left center length 1446, and center, right edge 1426 has a right center length 1448. In the illustrative embodiment, base center plate 1400 is smaller or similar in size to bottom wall 1100. In the illustrative embodiment, left center length 1446 is approximately 4.425 inches, and right center length 1448 is approximately five inches. In the illustrative embodiment, a wrist support-handle aperture width 1432 is defined between wrist support fastener aperture wall 1206 and a first aperture wall of the one or more handle fastener aperture walls 1208 and may be approximately 4.7 inches.

Base right plate 1402 may include right center boundary 1430, a right back edge 1418, a right edge 1420, a right, curved edge 1422, and a right, front edge 1424. Right edge 1420 may be parallel to handle lengthwise center line 606 that aligns with the one or more handle fastener aperture walls 1208 and aligns with handle angle 608. Right back edge 1418 extends from center, back edge 1416 forming a right, back angle 1436 between right center boundary 1430, which extends from center, back edge 1416 at a 90 degree angle (perpendicular), and right back edge 1418. In the illustrative embodiment, right, back angle 1436 is approximately 40 degrees though other angles may be used.

Right, front edge 1424 extends from center, right edge 1426 forming a right, front angle 1434 between right center boundary 1430 and right, front edge 1424, where right center boundary 1430 extends parallel to center, right edge 1426. In the illustrative embodiment, right, front angle 1434 is approximately 45 degrees though other angles may be used. Right edge 1420 extends between right back edge 1418 and right, curved edge 1422. A right edge angle 1438 is formed between right edge 1420 and right back edge 1418 and may be approximately 40 degrees though other angles may be used. Right, curved edge 1422 extends between right edge 1420 and right, front edge 1424. Right, curved edge 1422 may be curved to avoid sharp edges.

Base left plate 1404 may include a left front edge 1408, a left plate edge 1410, a curved transition edge 1412, and left center boundary 1428. Left front edge 1408 extends parallel to center, front edge 1406 a distance defined by a center, front width 1444. In the illustrative embodiment, center, front width 1444 is approximately one inch.

Left plate edge 1410 extends perpendicular to left front edge 1408. Curved transition edge 1412 extends between left plate edge 1410 and center, left edge 1414. In the illustrative embodiment, left plate edge 1410 has a left plate length 1466 of approximately 7.7 inches. Wrist support fastener aperture wall 1206 may be formed through base left plate 1404 a distanced shown as an aperture wall length 1468 measured relative to left front edge 1408. In an illustrative embodiment, aperture wall length 1468 is approximately 7.6 inches.

Transition wall 1202 may include a front transition edge 1450, a left transition edge 1452, a back transition edge 1454, and left plate edge 1410. Forearm support wall 1204 may include a front forearm support wall edge 1456, a left curved edge 1458, a left edge 1460, and a back curved edge 1462. Left curved edge 1458 and back curved edge 1462 are used to avoid sharp edges. In the illustrative embodiment, left edge 1460 has a left edge length 1464 of approximately 6.5 inches.

Figure 17:
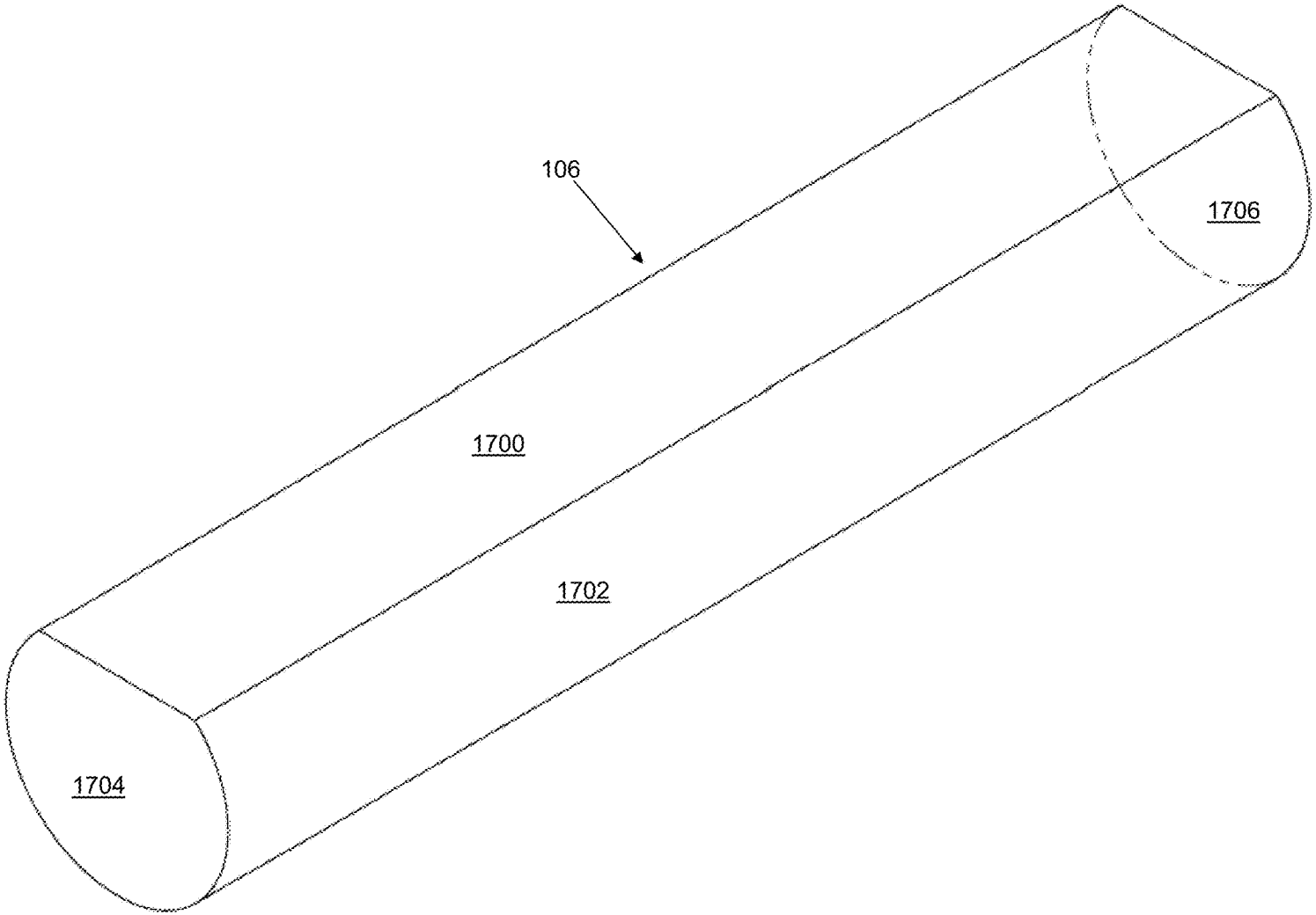
FIG. 17 depicts a top, front perspective view of a handle of the pan holder system of FIG. 1 in accordance with an illustrative embodiment.

Referring to FIG. 17, a top, front perspective view of handle 106 is shown in accordance with an illustrative embodiment. Handle 106 may include a top handle wall 1700, a curved handle wall 1702, a front handle wall 1704, and a back handle wall 1706. Top handle wall 1700 may be a flat wall. Top handle wall 1700 may be mounted to base right plate 1402 using one or more fasteners inserted through the one or more handle fastener aperture walls 1208 formed through base right plate 1402. Curved handle wall 1702 may be a semicircular or arc-shaped wall that extends from opposite edges of top handle wall 1700.

Front handle wall 1704 and back handle wall 1706 extend between top handle wall 1700 and curved handle wall 1702 and on opposite ends of handle 106. Handle 106 may be solid or hollow. As a result, front handle wall 1704 and back handle wall 1706 may be continuous throughout or define a wall thickness of top handle wall 1700 and curved handle wall 1702 that is suitable for use as a handle with a hollow interior. Curved handle wall 1702 is sized and shaped to fit and rest within a palm of a hand of a user when pan holder system 100 is held in the hand of the user for use. Curved handle wall 1702 may be covered with a different material such as wood, rubber, or other elastomeric material to render it less or non-slippery when wet or coated with the material retained in pan 102. In an illustrative embodiment, handle 106 has a length of approximately 8.5 inches though handle 106 may be shorter or longer. Curved handle wall 1702 may have a radius of 0.875 inches though other radii may be used or other arc shapes. Curved handle wall 1702 is sized and shaped to fit and rest within a palm of a hand of a user when pan holder system 100 is held in the hand of the user for use, for example, as shown referring to FIG. 29.

Figure 18:
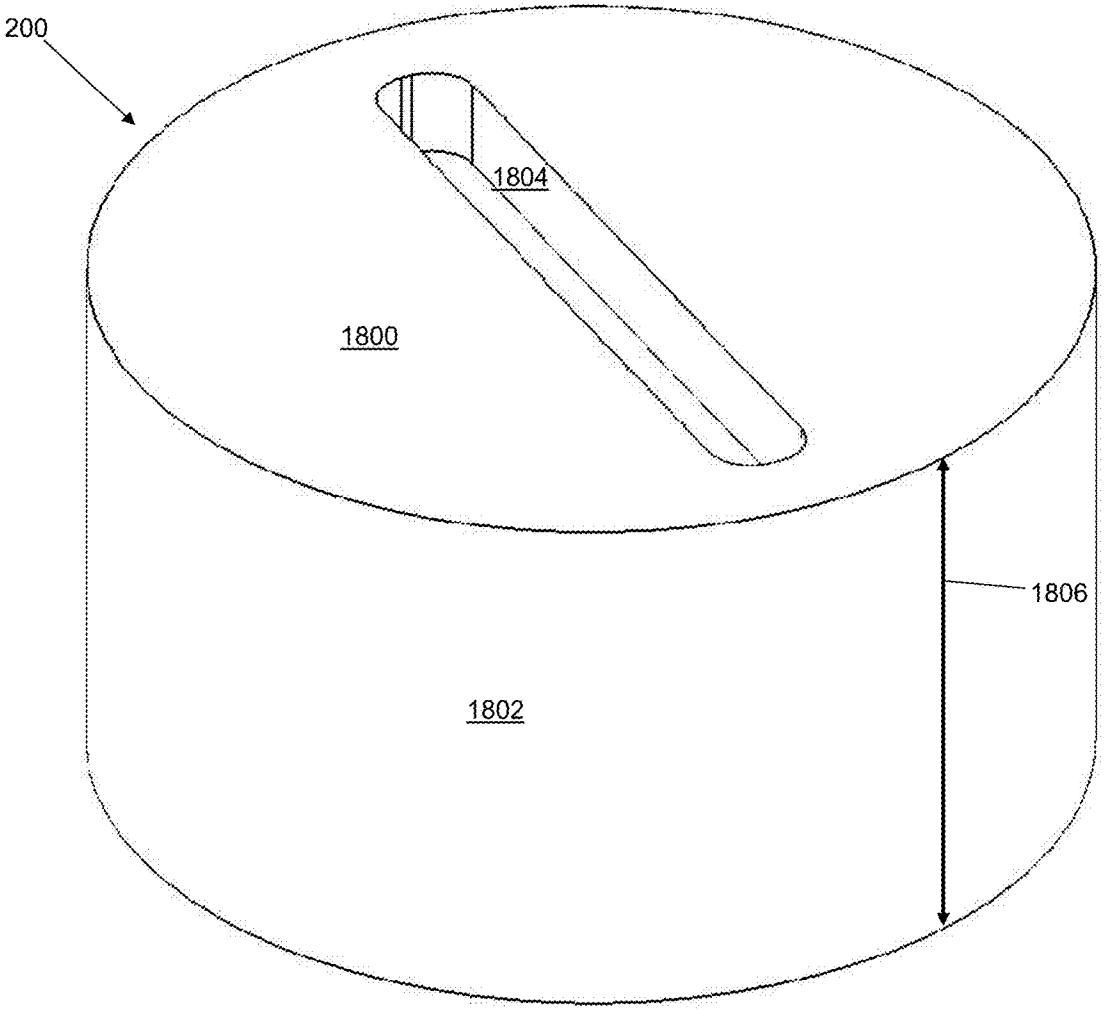
FIG. 18 depicts a top perspective view of a wrist support of the pan holder system of FIG. 1 in accordance with an illustrative embodiment.
Figure 19:
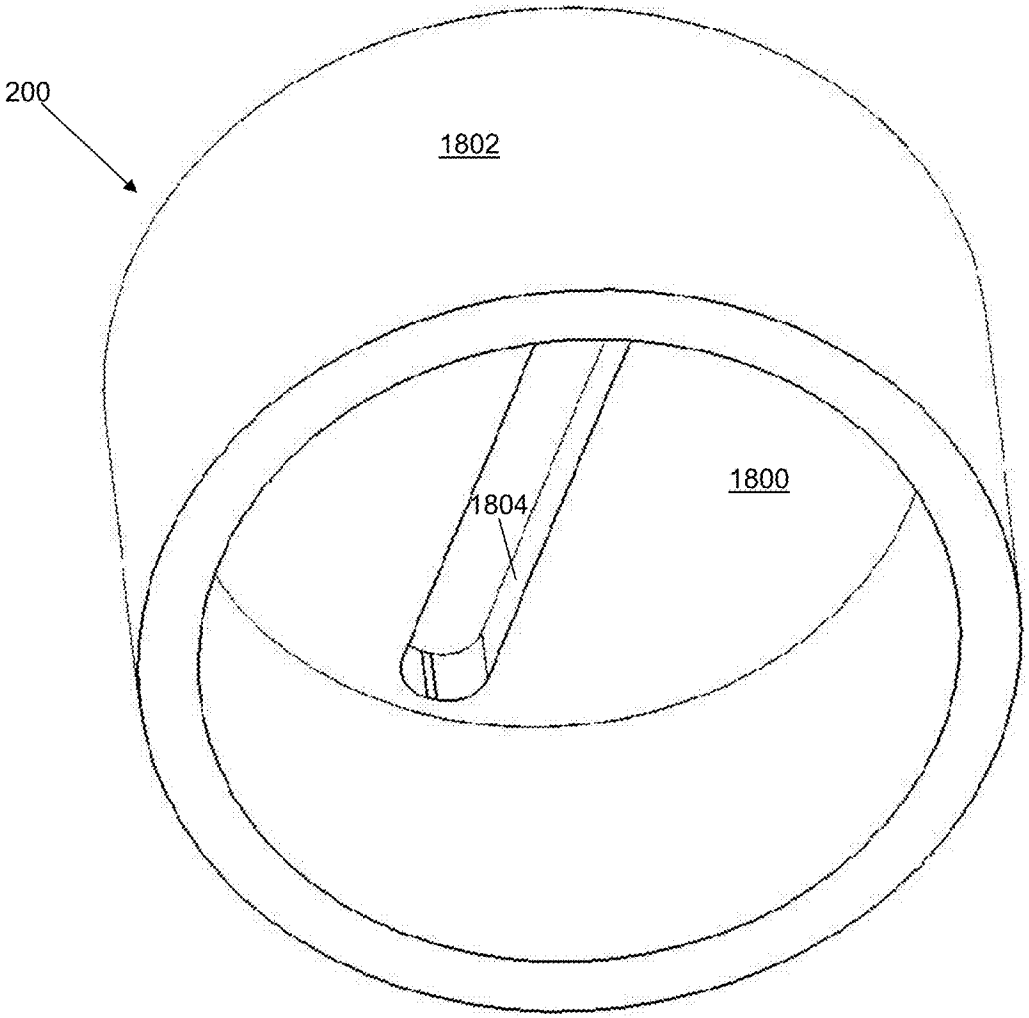
FIG. 19 depicts a bottom perspective view of the wrist support of FIG. 18 in accordance with an illustrative embodiment.
Figure 20:
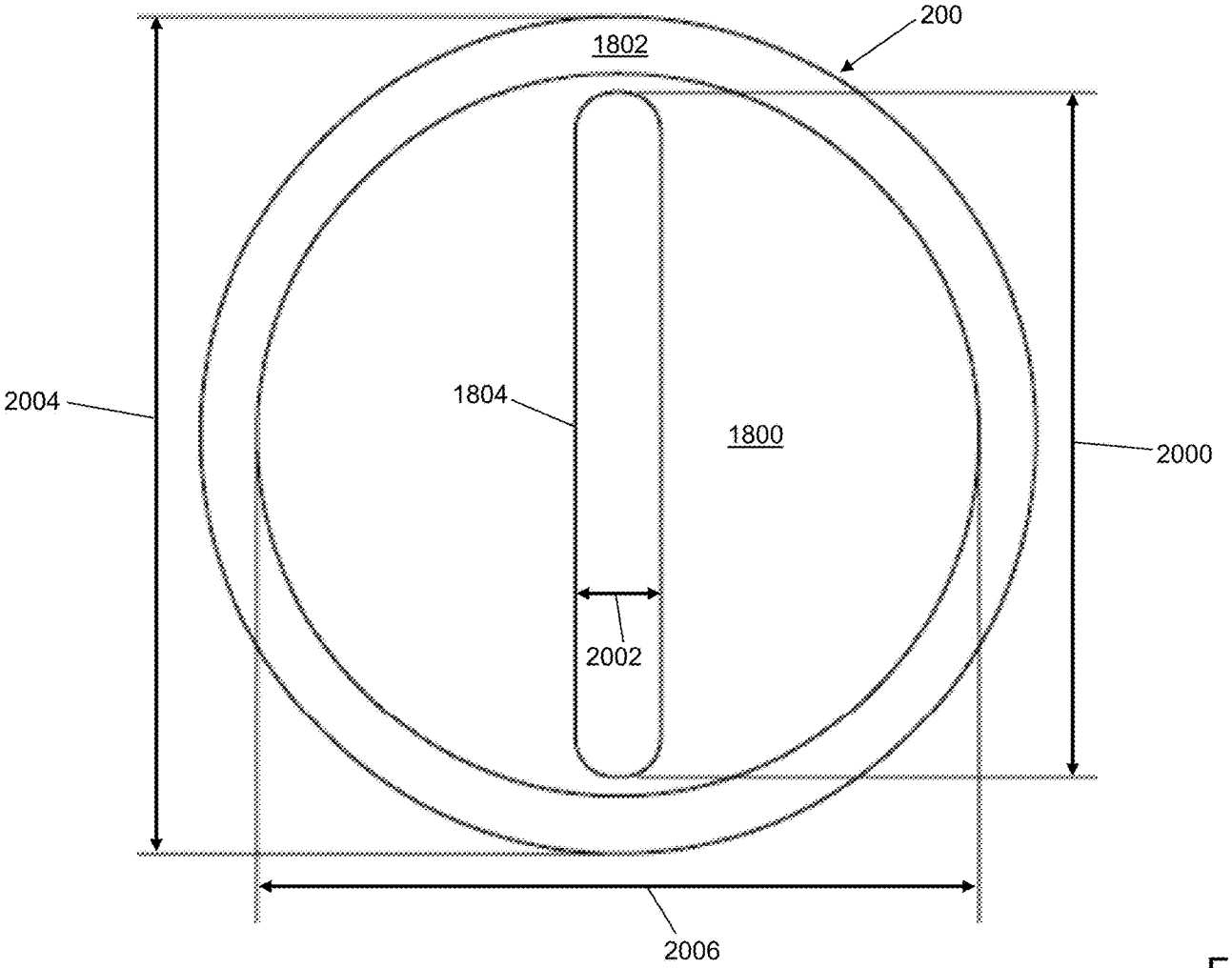
FIG. 20 depicts a bottom view of the wrist support of FIG. 18 in accordance with an illustrative embodiment.

Referring to FIG. 18, a top perspective view of wrist support 200 is shown in accordance with an illustrative embodiment. Referring to FIG. 19, a bottom perspective view of wrist support 200 is shown in accordance with an illustrative embodiment. Referring to FIG. 20, a bottom view of wrist support 200 is shown in accordance with an illustrative embodiment. Wrist support 200 may include a top wrist support wall 1800 and a curved wrist support wall 1802. Curved wrist support wall 1802 may be circular, semicircular, or arc-shaped. In the illustrative embodiment, curved wrist support wall 1802 forms a cylinder having an exterior diameter 2004 of approximately 2.75 inches and an interior diameter 2006 of approximately 2.375 inches. Curved wrist support wall 1802 may have a height 1806 of approximately 1.25 inches. Height 1806 may be selected to be similar to a height of handle 106 so that when pan holder system 100 is set on a horizontal surface, pan 102 remains approximately horizontal to avoid spilling of any material retained in pan 102. Curved wrist support wall 1802 may have other diameters or other arc shapes designed to support a wrist-thumb portion of the hand of the user when pan holder system 100 is held in the hand of the user for use.

A wrist support slit aperture wall 1804 is formed through top wrist support wall 1800. In the illustrative embodiment, wrist support slit aperture wall 1804 forms an elongated slit with a slit length 2000 of approximately 2.25 inches and with a slit width 2002 of approximately 0.28 inches. In an alternative embodiment, wrist support slit aperture wall 1804 may be circular or have other shapes to accommodate a fastener such as a screw or rivet. In an alternative embodiment, top wrist support wall 1800 may not include wrist support slit aperture wall 1804. Instead, top wrist support wall 1800 may be mounted to base left plate 1404, for example, by molding, soldering, adhesive, etc.

Curved wrist support wall 1802 extends from top wrist support wall 1800 that is mounted to base left plate 1404. For example, top wrist support wall 1800 is mounted to base left plate 1404 using a fastener inserted through wrist support slit aperture wall 1804. In an alternative embodiment, curved wrist support wall 1802 may mount directly to base left plate 1404, for example, by molding, soldering, adhesive, etc.

In the illustrative embodiment, wrist support slit aperture wall 1804 forms an elongated racetrack to support adjustment of left-right distance 600 and/or front-back distance 602 (shown referring to FIG. 6) by rotating and sliding wrist support 200 relative to wrist support fastener aperture wall 1206.

Figure 21:
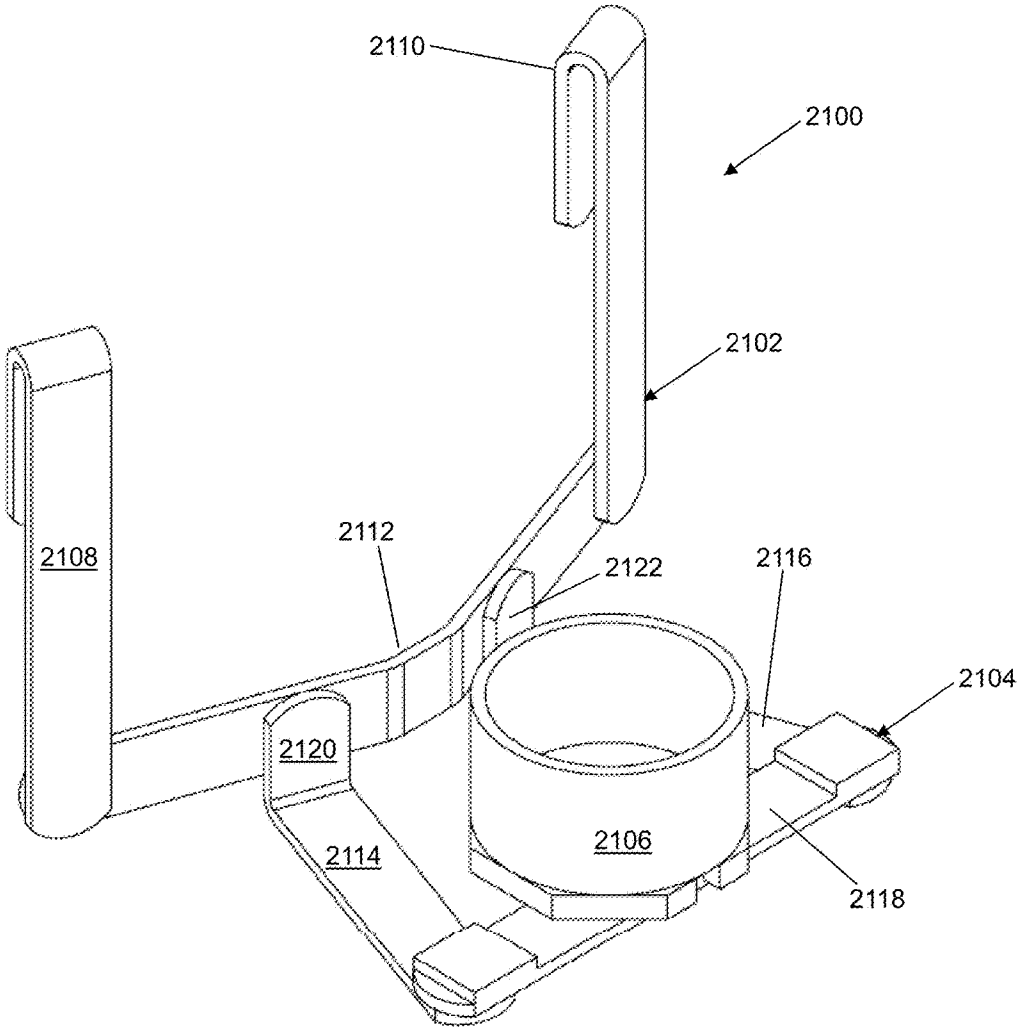
FIG. 21 depicts a top, front, left perspective view of a holster system of the pan holder system of FIG. 1 in accordance with an illustrative embodiment.
Figure 22:
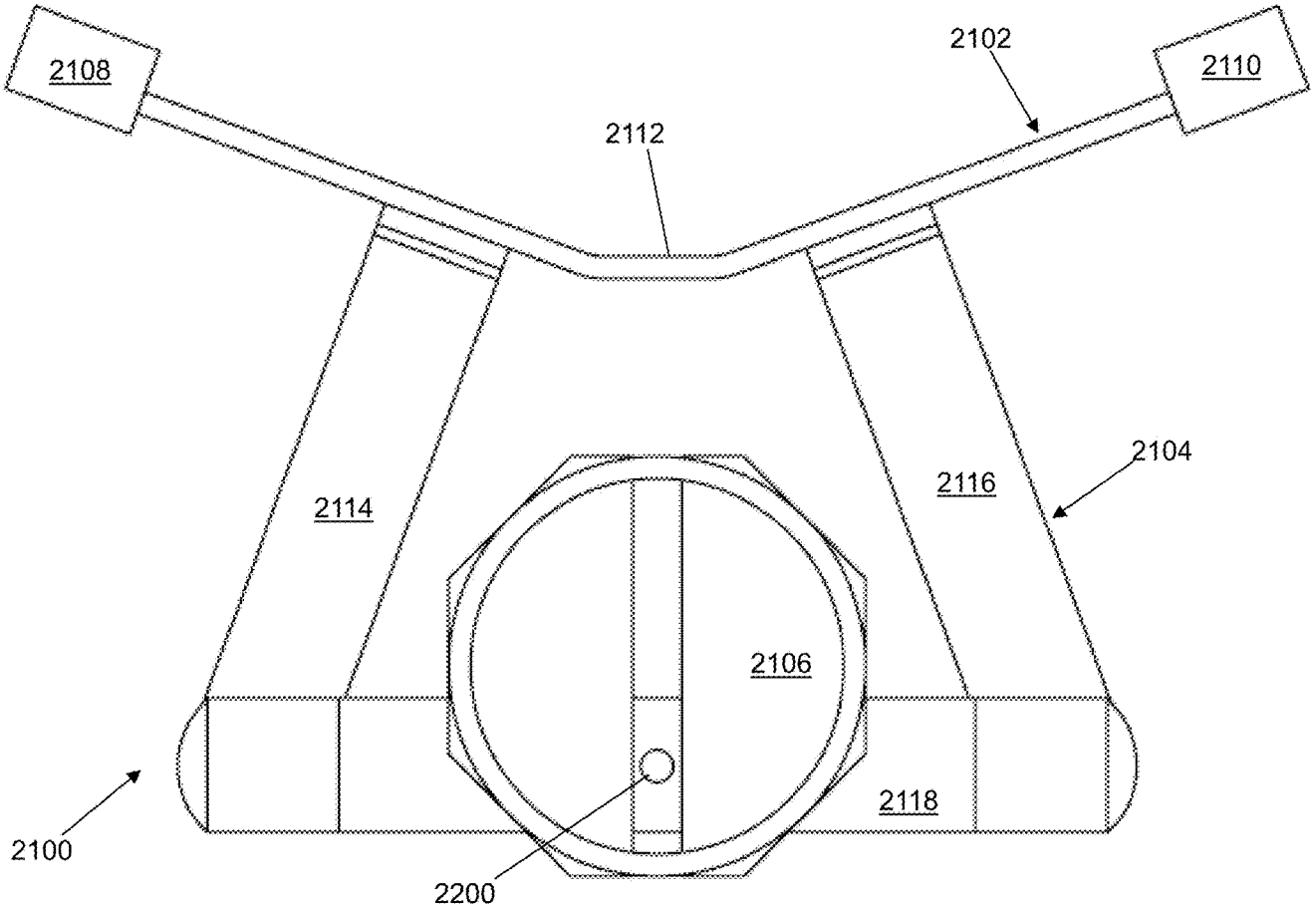
FIG. 22 depicts a top view of the holster system of FIG. 21 in accordance with an illustrative embodiment.
Figure 23:
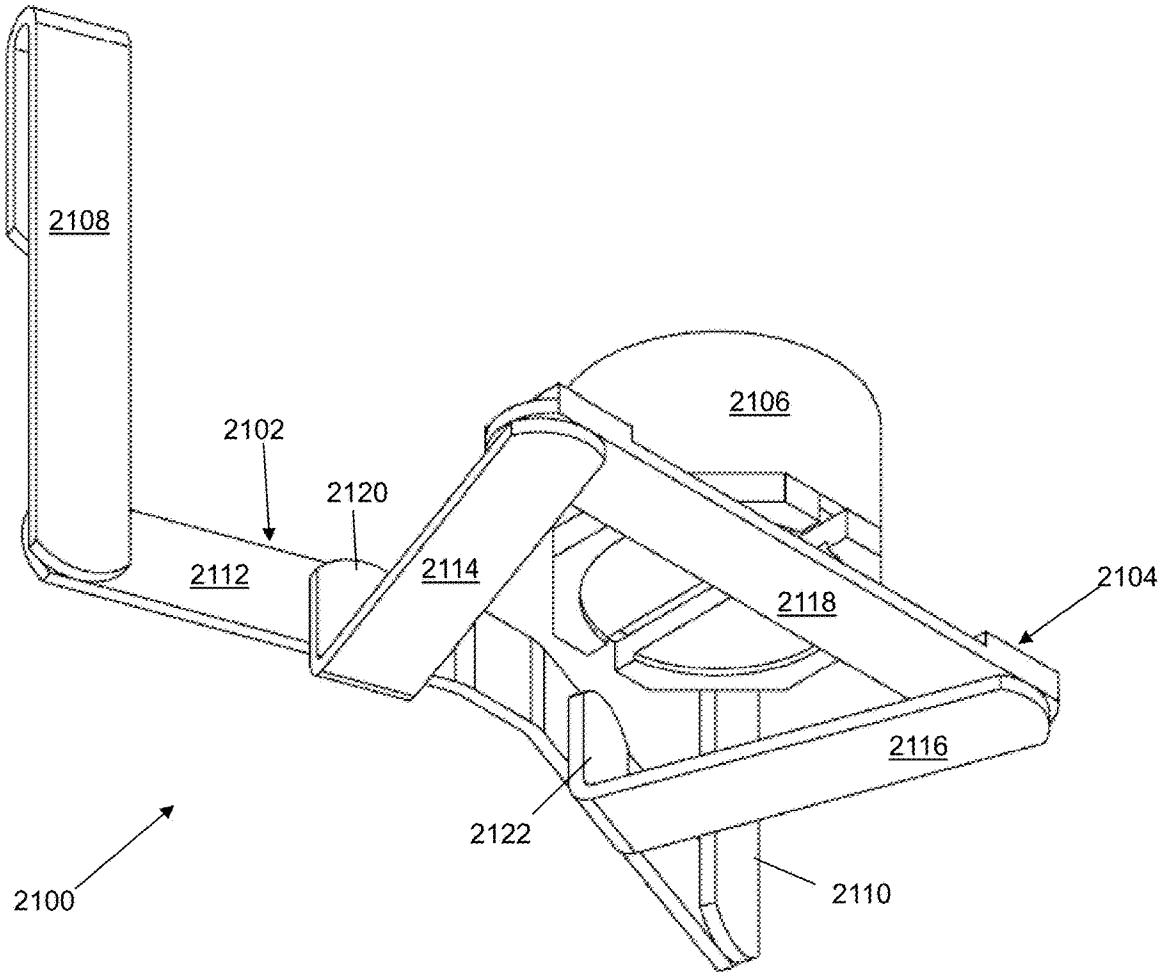
FIG. 23 depicts a bottom, front, left perspective view of the holster system of FIG. 21 in accordance with an illustrative embodiment.
Figure 24:
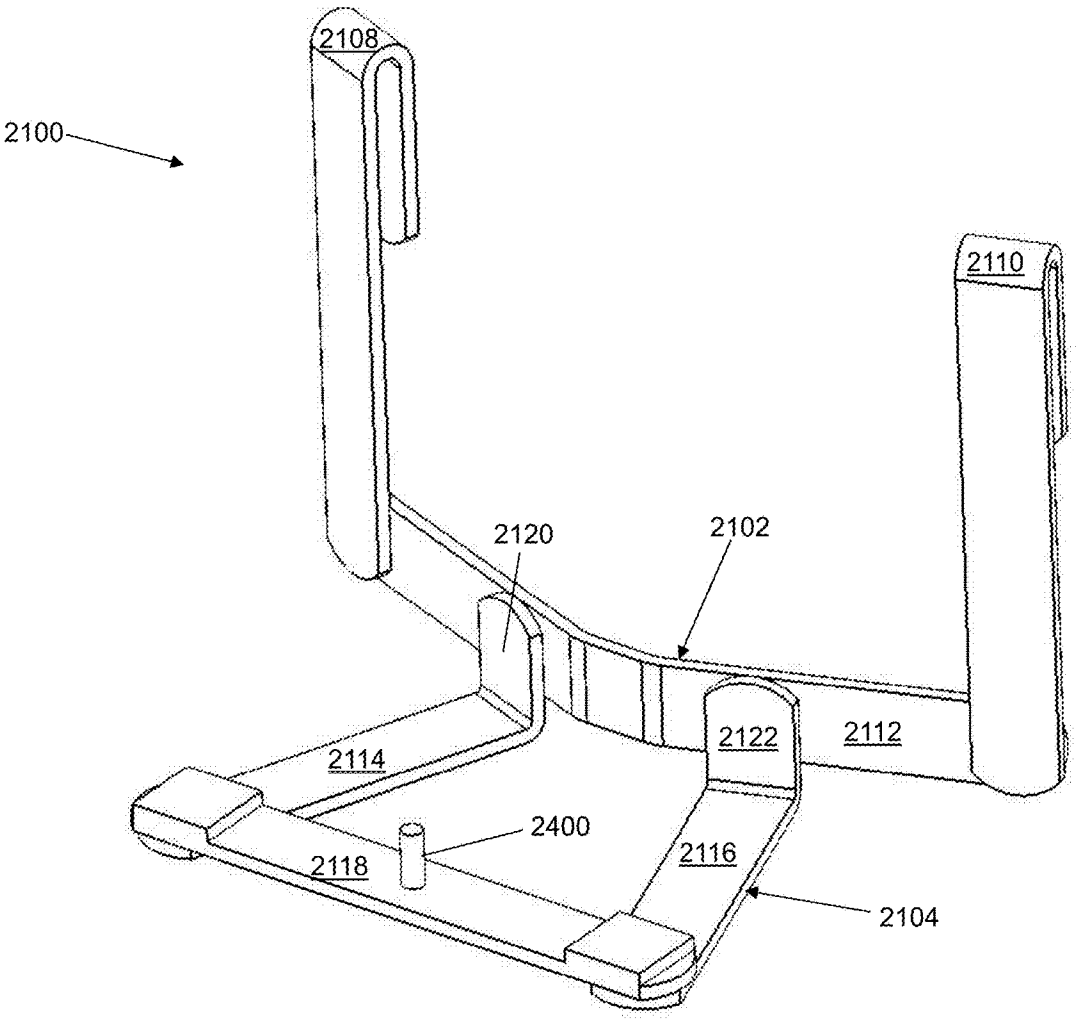
FIG. 24 depicts a top, front, right perspective view of the holster system of FIG. 21 without a holster post in accordance with an illustrative embodiment.

Referring to FIG. 21, a top, front, left perspective view of a holster system 2100 of pan holder system 100 is shown in accordance with an illustrative embodiment. Referring to FIG. 22, a top view of holster system 2100 is shown in accordance with an illustrative embodiment. Referring to FIG. 23, a bottom, front, left perspective view of holster system 2100 is shown in accordance with an illustrative embodiment. Referring to FIG. 24, a top, front, right perspective view of holster system 2100 without a holster post is shown in accordance with an illustrative embodiment.

In the illustrative embodiment, holster system 2100 may include a holster 2102, a holster post support 2104, and a holster post 2106. Holster 2102 may include a first holster hanger 2108, a second holster hanger 2110, and a holster hanger brace 2112. First holster hanger 2108 and second holster hanger 2110 are sized and shaped to mount to a generally horizontal item such as a belt of a user or a support of a ladder. For example, first holster hanger 2108 and second holster hanger 2110 include hooks. Holster hanger brace 2112 mounts first holster hanger 2108 to second holster hanger 2110, for example, using soldering, molding, fasteners, adhesive, etc.

Holster post support 2104 may include a first holster post support arm 2114, a second holster post support arm 2116, and a holster post support brace 2118. First holster post support arm 2114 and second holster post support arm 2116 mount to and extend in a generally horizontal direction from holster hanger brace 2112, for example, using soldering, molding, fasteners, adhesive, etc. For illustration, a first support arm fastener 2120 mounts first holster post support arm 2114 to holster hanger brace 2112, and a second support arm fastener 2122 mounts second holster post support arm 2116 to holster hanger brace 2112. Holster post support brace 2118 mounts first holster post support arm 2114 to second holster post support arm 2116, for example, using soldering, molding, fasteners, adhesive, etc.

Holster post 2106 is mounted on and supported by holster post support brace 2118. For illustration, a holster post mounting aperture wall 2200 is formed through holster post support brace 2118 and through a bottom wall of holster post 2106, and a post fastener 2400 (shown referring to FIG. 24) is inserted through each aperture wall to mount holster post 2106 to holster post support brace 2118.

Figure 25:
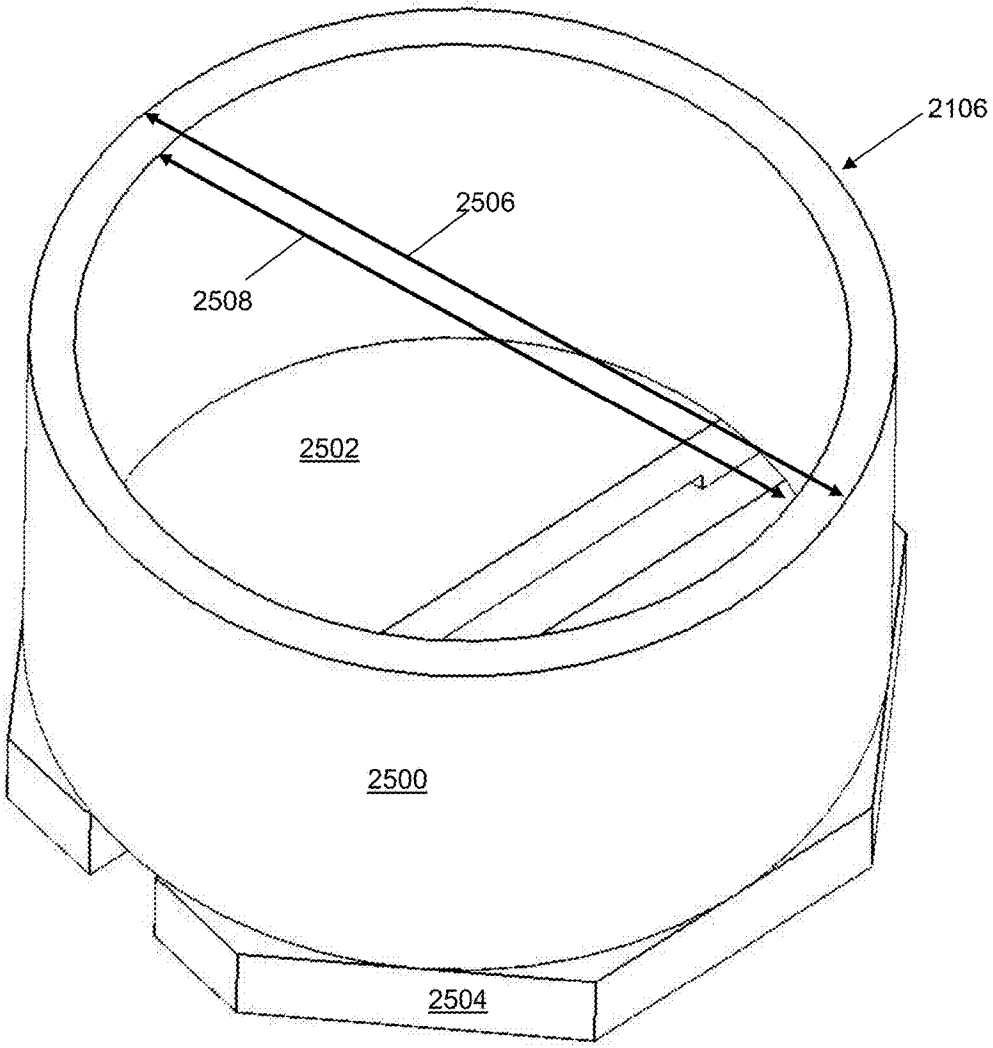
FIG. 25 depicts a top perspective view of the holster post of the holster system of FIG. 21 in accordance with an illustrative embodiment.

Referring to FIG. 25, a top perspective view of holster post 2106 of holster system 2100 is shown in accordance with an illustrative embodiment. Holster post 2106 may include a curved holster post sidewall 2500, a first bottom holster post wall 2502, and a second bottom holster post wall 2504. Curved holster post sidewall 2500 is sized and shaped so that wrist support 200 can mount to holster post 2106. For example, an interior diameter 2508 of curved holster post sidewall 2500 may be selected to be greater than exterior diameter 2004 of curved wrist support wall 1802 of wrist support 200. As another option, an exterior diameter 2506 of curved holster post sidewall 2500 may be selected to be less than interior diameter 2006 of curved wrist support wall 1802 of wrist support 200. Holster post 2106 may be identical to wrist support 200 except with a different diameter so that one fits within the other.

Holster post 2106 may have fewer or a greater number of bottom walls from which curved holster post sidewall 2500 extends upward. For example, curved holster post sidewall 2500 may be mounted directly to holster post support brace 2118 without any bottom wall. As another example, holster post 2106 may include a single bottom with an aperture similar to wrist support slit aperture wall 1804.

In the illustrative embodiment, holster post 2106 includes first bottom holster post wall 2502 and second bottom holster post wall 2504 that are separated by a gap that forms an elongated slit between them to adjust a distance of holster post 2106 relative to holster hanger brace 2112. By adjusting the distance, when wrist support 200 is mounted to holster post 2106, pan 102 is positioned an adjustable distance from the item to which holster system 2100 is hung such as a ladder or a waist of the user.

Figure 26:
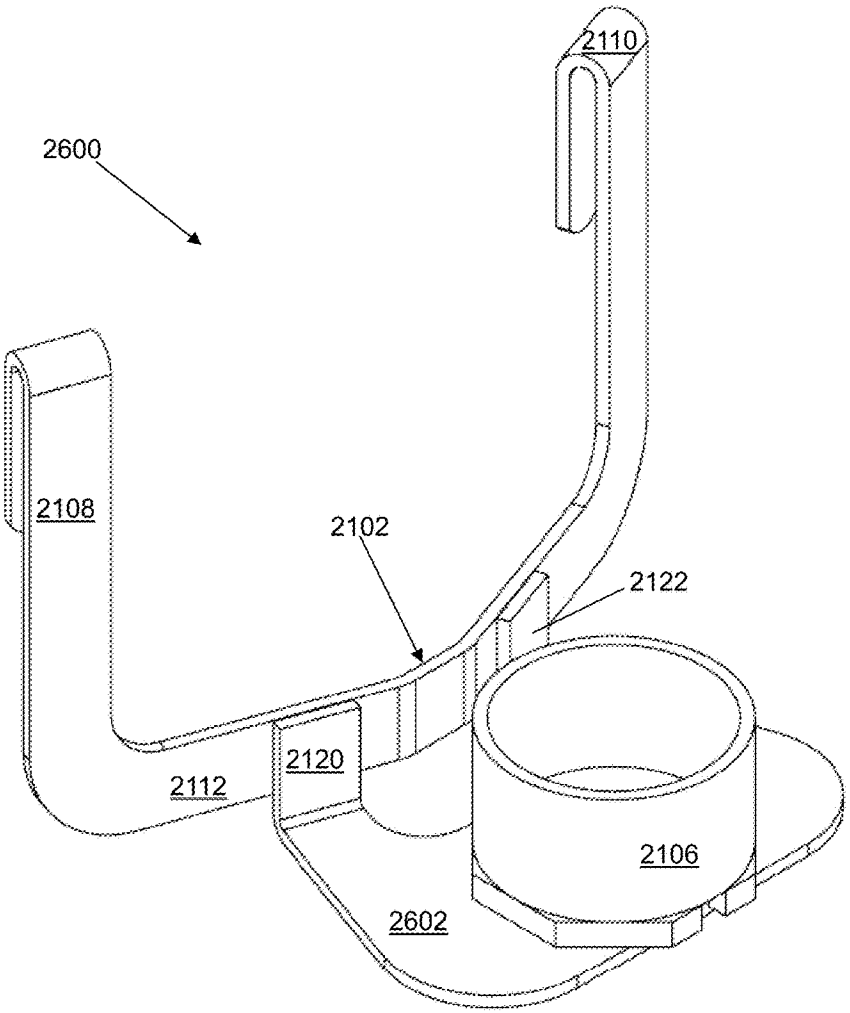
FIG. 26 depicts a top, front, left perspective view of a second holster system of the pan holder system of FIG. 1 in accordance with an illustrative embodiment.
Figure 27:
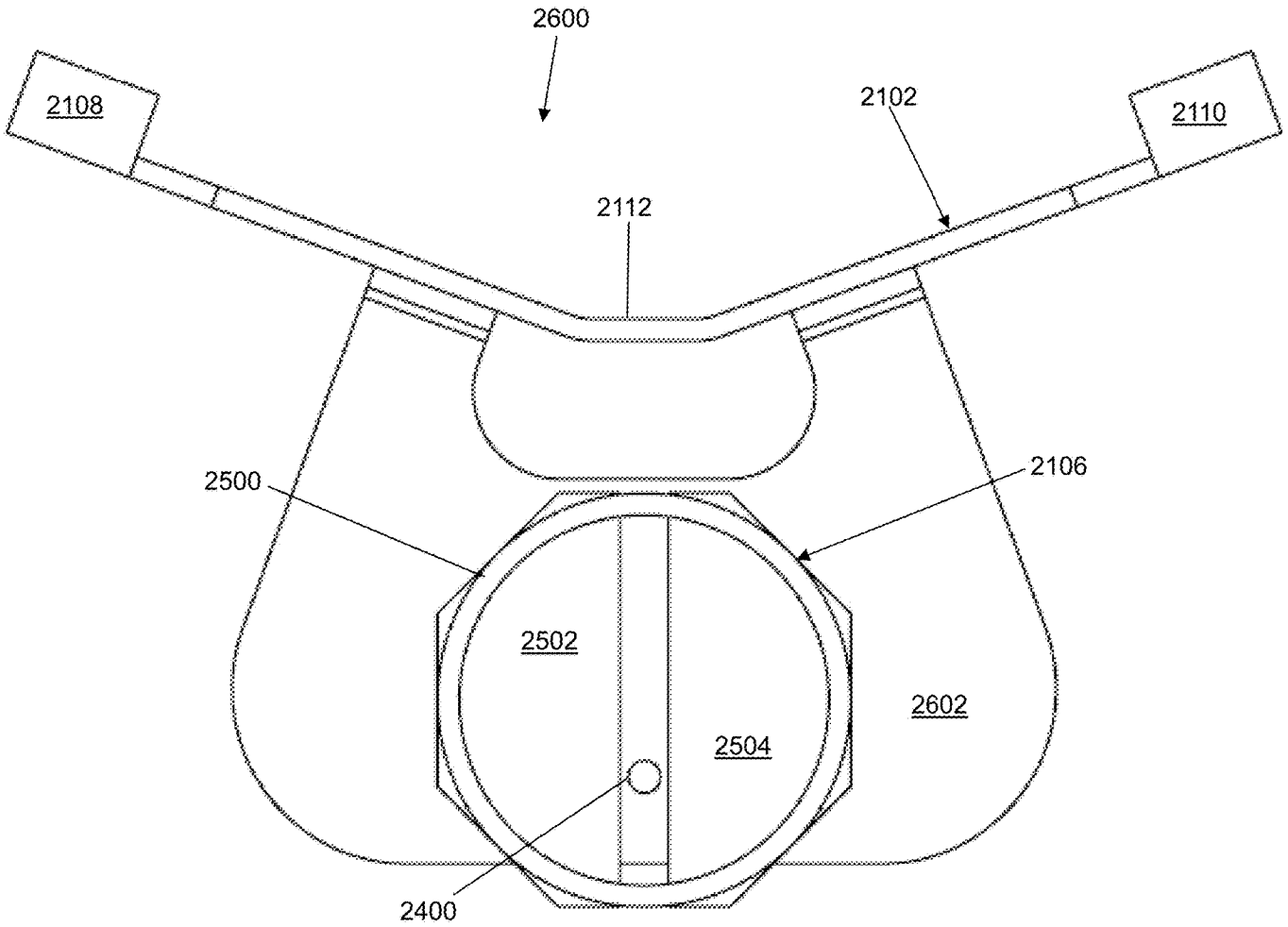
FIG. 27 depicts a top view of the second holster system of FIG. 26 in accordance with the illustrative embodiment.

Referring to FIG. 26, a top, front, left perspective view of a second holster system 2600 of pan holder system 100 is shown in accordance with an illustrative embodiment. Referring to FIG. 27, a top view of second holster system 2600 is shown in accordance with an illustrative embodiment. Second holster system 2600 is similar to holster system 2100 except that second holster system 2600 includes a holster post support wall 2602 instead of first holster post support arm 2114, second holster post support arm 2116, and holster post support brace 2118. Post fastener 2400 mounts to holster post support wall 2602 to support wrist support 200.

Figure 28:
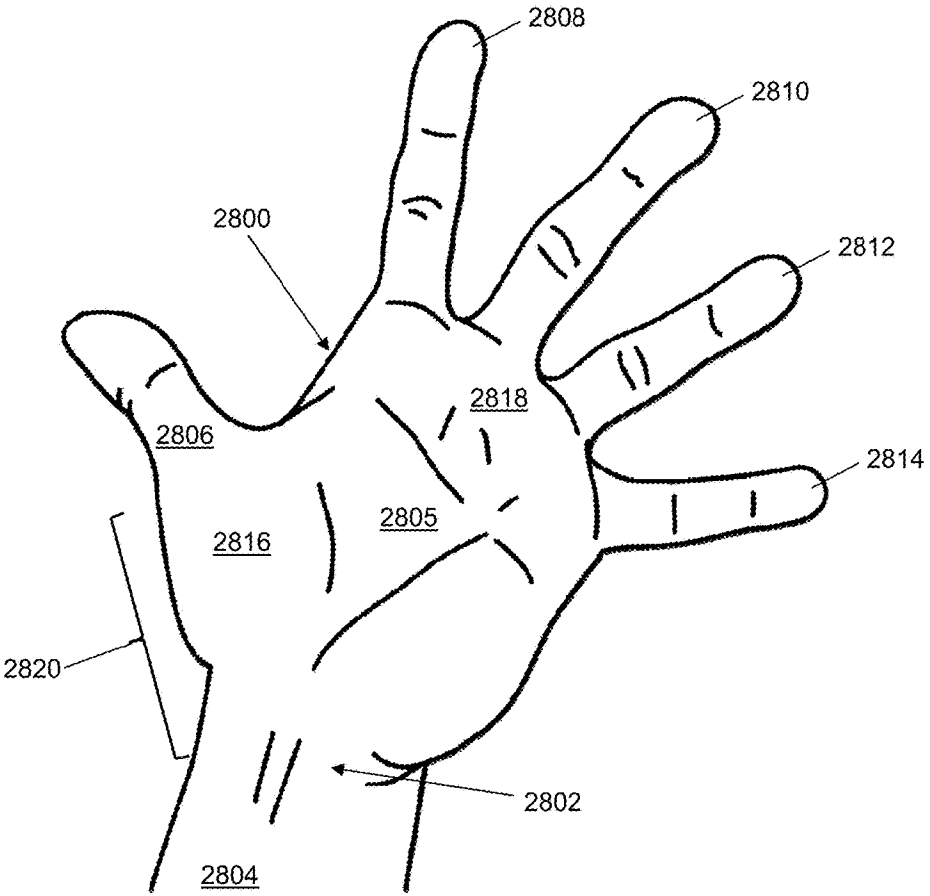
FIG. 28 depicts a view of a palm side of a hand in accordance with an illustrative embodiment.

Referring to FIG. 28, a view of a palm side of a hand 2800, a wrist 2802, and a portion of a forearm 2804 is shown in accordance with an illustrative embodiment. Hand 2800 may include a palm 2805, a thumb 2806, an index finger 2808, a middle finger 2810, a ring finger 2812, and a pinky finger 2814. Palm 2805 includes an underside of hand 2800 and includes the area between thumb 2806, the fingers, and wrist 2802. Palm 2805 may include a thumb-palm portion 2816 and a finger-palm portion 2818. A thumb-wrist portion 2820 is illustrated as an outer surface adjacent thumb-palm portion 2816 and wrist 2802.

Referring to FIG. 29, a bottom perspective view of pan holder system 100 being held by a user is shown in accordance with an illustrative embodiment. Handle 106 rests in palm 2805 with the fingers wrapping around an outside edge of handle 106 and thumb 2806 abutting an inside edge of handle 106. Thumb-wrist portion 2820 abuts and is supported by wrist support wall 1802 of wrist support 200. At least a portion of base plate 1200 rests on forearm 2804. In particular, base center plate 1400, base left plate 1404, transition wall 1202, and forearm support wall 1204 rest on forearm 2804. When the user retrieves the material from pan 102, downward pressure is exerted on the pan. The user further may tilt pan 102 at an angle such that forearm support wall 1204 rests on forearm 2804 that is approximately horizontal.

Pan holder system 100 is designed to be held in various positions and to be moved freely between those positions as the user needs. In a basic holding position, base 104 rests on the user's forearm 2804, wrist support 200 rests against the user's thumb-wrist portion 2820 and handle 106 rests in the user's palm 2805, with the user's fingers wrapped around handle 106 in a natural grip position. Pan holder system 100 is designed so that the weight of the contents in pan 102 are evenly distributed over the user's hand 2800, wrist 2802, and forearm 2804, and the user can hold pan 102 comfortably without pan 102 tipping to either side and without the user needing to squeeze hard on handle 106. This allows freedom of movement for the user.

The basic holding position also allows the user to dip a putty knife or other tool into pan 102 to retrieve the contents while maintaining control of pan 102 without having to hold a wet, slippery pan. The weight of the user pushing down with the opposite hand is again distributed evenly over the user's hand 2800, palm 2805, wrist 2802, and forearm 2804, which reduces fatigue and long-term joint problems and muscle strain.

After the user has retrieved the contents on the putty knife, pan holder system 100 can easily be slid into another position by a downward motion of wrist 2802 to allow base 104 to slide up, handle 106 to slide down, and pan 102 to be more horizontal allowing the user to wipe off excess material from the putty knife or other tool. This back and forth motion is consistently needed for the user to dip in and out for material and wipe off excess, which is repeated over and over again. The ability of pan holder system 100 to slide easily from one position to the next provides for an efficient ease of use.

As the user dips and wipes repeatedly, there is a tendency for excess material to drip off an edge of pan 102 causing pan 102 to become wet and slippery. Pan holder system 100 allows for any drips and dried chunks to land on the outer edges of base 104 keeping the area that touches the user's forearm 2804 and palm 2805 clean. There is also the option of storing the putty knife between base 104 and pan 102 when not in use to free up the opposite hand of the user.

When pan holder system 100 is not in use, it can be set on any flat surface without spilling the contents because it is properly balanced. Pan holder system 100 can also be mounted to holster system 2100, 2600 that may be attached to a user's belt or a ladder.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A pan holder comprising:

a base plate comprising an interior surface and an exterior surface;

a handle comprising a first arc-shaped wall and a flat wall, wherein the flat wall is mounted to the exterior surface of the base plate, wherein the first arc-shaped wall extends from opposite edges of the flat wall and the first arc-shaped wall is sized to fit and rest within a palm of a hand when the pan holder is held by a user; and a wrist support comprising a second arc-shaped wall mounted to the exterior surface of the base plate to extend perpendicularly from the exterior surface of the base plate, wherein a minimum distance between the first arc-shaped wall and the second arc-shaped wall is configured to accommodate a thumb-wrist portion of the hand when the pan holder is held by the user, wherein the second arc-shaped wall is curved when projected into a first plane defined by the exterior surface of the base plate, wherein the second arc-shaped wall is concave relative to a second plane, wherein the second plane extends through a lengthwise center of the handle and is perpendicular to the first plane.

2. The pan holder of claim 1, wherein the wrist support is configured to be movable to select the minimum distance between the first arc-shaped wall and the second arc-shaped wall.

3. The pan holder of claim 2, wherein the wrist support is further configured to be movable to select a second distance between the second arc-shaped wall and an edge of the base plate.

4. The pan holder of claim 1, wherein the wrist support further comprises:

a wrist support wall mounted between the exterior surface of the base plate and the second arc-shaped wall, wherein the wrist support wall includes an elongated slit formed through the wrist support wall; and a fastener comprising a head and a shaft, wherein the shaft is inserted though the elongated slit and the head has a width that is greater than a width of the elongated slit to mount the wrist support to the base plate.

5. The pan holder of claim 4, wherein the elongated slit is rotated relative to the shaft to select the minimum distance between the first arc-shaped wall and the second arc-shaped wall.

6. The pan holder of claim 5, wherein the fastener is further positioned within the elongated slit to select the minimum distance between the first arc-shaped wall and the second arc-shaped wall.

7. The pan holder of claim 5, wherein the fastener is further positioned within the elongated slit to select a second distance between the second arc-shaped wall and an edge of the base plate.

8. The pan holder of claim 1, wherein the minimum distance is between one inch and five inches.

9. The pan holder of claim 1, wherein the first arc-shaped wall of the handle is formed of a wood material or a rubber material.

10. The pan holder of claim 1, further comprising:

a forearm support wall mounted to and extending from the base plate on a side of the wrist support opposite the handle, wherein the forearm support wall curves upward relative to the first plane in a direction opposite the second arc-shaped wall.

11. The pan holder of claim 10, wherein the forearm support wall curves upward at an angle between 105 and 180 degrees relative to the interior surface of the base plate.

12. The pan holder of claim 1, further comprising:

a pan comprising a bottom wall and a plurality of walls that extend from the bottom wall to form an open container, wherein the bottom wall is mounted to the interior surface of the base plate and the plurality of walls extend from an opposite side of the base plate than the second arc-shaped wall extends from the base plate.

13. The pan holder of claim 12, wherein the bottom wall is formed by the base plate.

14. The pan holder of claim 12, wherein the bottom wall is attached to the interior surface of the base plate.

15. The pan holder of claim 12, wherein the base plate comprises the bottom wall, a first base plate, and a second base plate, wherein the first base plate extends from a first side of the bottom wall, wherein the second base plate extends from a second side of the bottom wall, wherein the first side is opposite the second side, wherein the handle is mounted to the first base plate, and the wrist support is mounted to the second base plate.

16. The pan holder of claim 15, further comprising:

a forearm support wall mounted to and extending from the second base plate on a side of the wrist support opposite the handle, wherein the forearm support wall curves upward relative to the first plane in a direction opposite the second arc-shaped wall.

17. The pan holder of claim 16, wherein the forearm support wall extends a length of the bottom wall.

18. The pan holder of claim 15, wherein the lengthwise center of the handle is mounted to the base plate to form an angle between 5 degrees and 45 degrees relative to a third plane, wherein the third plane is perpendicular to the base plate and is parallel to the first side.

19. The pan holder of claim 15, further comprising a fastener inserted through the first base plate and into the flat wall of the handle.

20. The pan holder of claim 1, further comprising:

a holster comprising a hanger;

a hanger brace mounted to extend outward from the hanger; and a post mounted to extend upward from the hanger brace, wherein the post is configured to mount the wrist support to the hanger brace.

* * * * *